US011441474B2

(12) United States Patent
Fluharty et al.

(10) Patent No.: US 11,441,474 B2
(45) Date of Patent: Sep. 13, 2022

(54) INTEGRATED EXHAUST MANIFOLD COOLING JACKET

(71) Applicant: Ford Global Technologies, LLC, Dearborn, MI (US)

(72) Inventors: Jeff Fluharty, Woodhaven, MI (US); Forest Heggie, LaSalle (CA); Phil Cierpial, Grosse Pointe Park, MI (US); Chad Ramsby, Dearborn, MI (US); Jon LaCroix, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 17 days.

(21) Appl. No.: 16/951,948

(22) Filed: Nov. 18, 2020

(65) Prior Publication Data

US 2022/0154624 A1 May 19, 2022

(51) Int. Cl.

| | |
|---|---|
| ***F01N 3/02*** | (2006.01) |
| ***F01N 13/10*** | (2010.01) |
| ***F01P 3/20*** | (2006.01) |
| ***F02F 1/24*** | (2006.01) |

(52) U.S. Cl.

CPC ..... *F01N 13/10* (2013.01); *F01P 3/20* (2013.01); *F02F 1/243* (2013.01); *F01P 2060/16* (2013.01)

(58) Field of Classification Search

CPC ..... F02F 1/40; F02F 1/243; F01P 3/02; F01P 2003/024; F01P 2003/027

USPC ..... 60/321

See application file for complete search history.

(56) References Cited

U.S. PATENT DOCUMENTS

| | | | | |
|---|---|---|---|---|
| 7,784,442 | B2 | 8/2010 | Lester et al. | |
| 8,584,628 | B2 | 11/2013 | Brewer et al. | |
| 8,875,670 | B2 | 11/2014 | Brewer et al. | |
| 10,087,894 | B2 | 10/2018 | Beyer et al. | |
| 2012/0312257 | A1* | 12/2012 | Beyer | F02F 1/40 123/41.82 R |

FOREIGN PATENT DOCUMENTS

| | | | | |
|---|---|---|---|---|
| DE | 102012215317 | A1 | 3/2013 | |
| EP | 2500558 | A1 * | 9/2012 | F02F 1/243 |
| JP | 2014084737 | A | 5/2014 | |

* cited by examiner

*Primary Examiner* — Long T Tran
*Assistant Examiner* — James J Kim
(74) *Attorney, Agent, or Firm* — Vincent Mastrogiacomo; McCoy Russell LLP

(57) ABSTRACT

Systems for an integrated exhaust manifold cylinder head are provided. In one example, an exhaust manifold for a vehicle includes a plurality of exhaust runners coupling a plurality of cylinder exhaust gas outlet ports to an exhaust exit port, the plurality of exhaust runners forming at least a first exhaust passage and a second exhaust passage at the exhaust exit port; an upper cooling jacket positioned vertically above the first exhaust passage; a lower cooling jacket positioned vertically below the second exhaust passage; and a central cooling jacket positioned vertically below the first exhaust passage and vertically above the second passage.

17 Claims, 11 Drawing Sheets
(2 of 11 Drawing Sheet(s) Filed in Color)

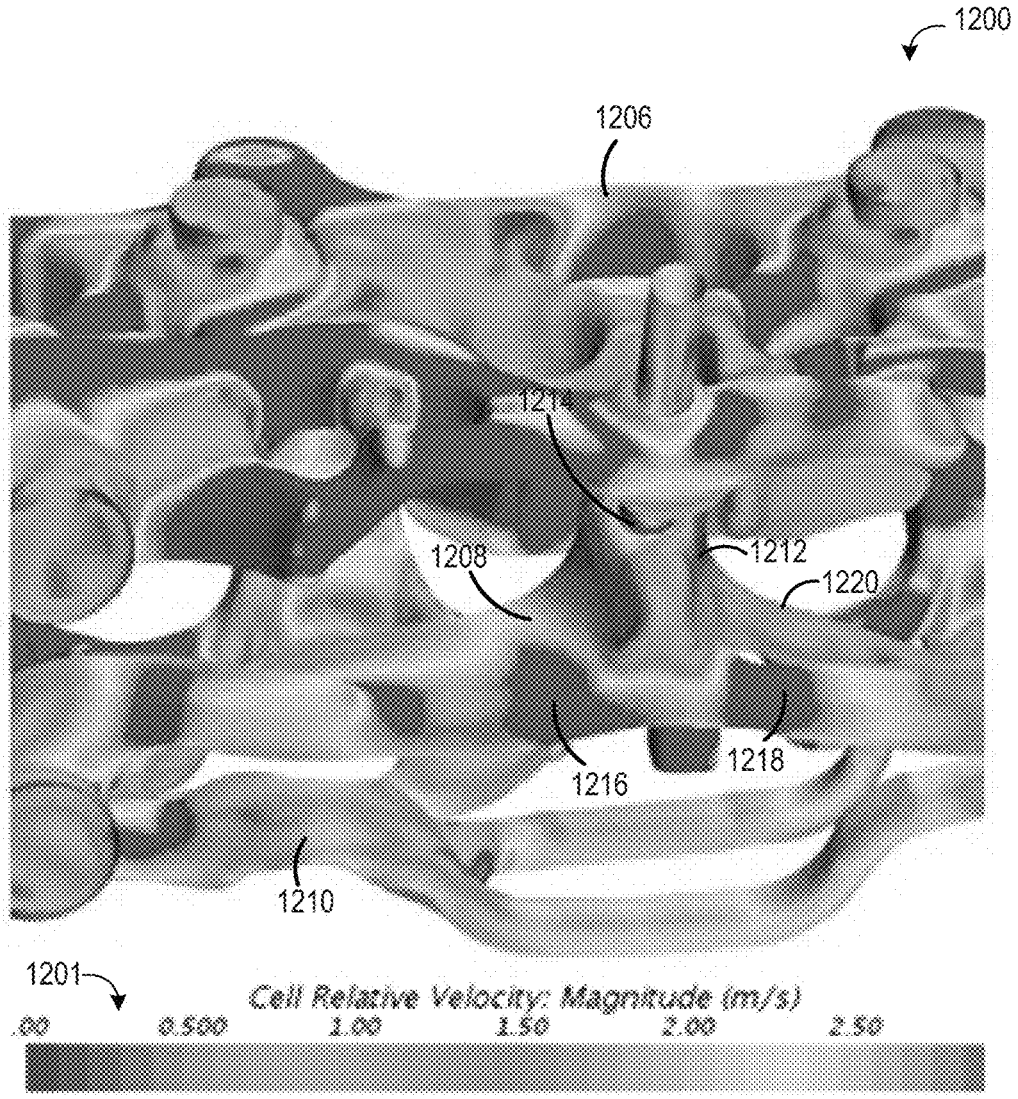
FIG. 12A
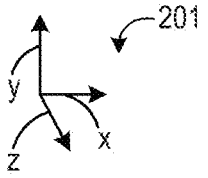

INTEGRATED EXHAUST MANIFOLD COOLING JACKET

FIELD

The present description relates generally to a cylinder head for a vehicle, and more specifically to a cylinder head including an integrated exhaust manifold having a central cooling jacket.

BACKGROUND/SUMMARY

Exhaust manifolds for internal combustion engines may be exposed to high thermal loads. Exhaust manifolds that are integrated into cylinder heads, referred to as integrated exhaust manifold (IEM) cylinder heads, may experience particularly high thermal loading due to the heat transfer characteristics of the integrated design. For example, IEM cylinder heads may include an exhaust exit port having one or more exhaust passages, which experiences a high thermal load during operation of the vehicle.

Thermal loading of an integrated exhaust manifold and neighboring components can be reduced by incorporating cooling jackets into the cylinder head. The cooling jackets with a coolant core formed therein can reduce the thermal stresses on the cylinder head caused by heat generated during engine operation. For example, a cylinder head having an integrated exhaust manifold is disclosed in U.S. Pat. No. 8,960,137. To reduce the thermal load placed on the exhaust exit port, upper and lower cooling jackets are provided, which encompass a major portion of the cylinder head to remove heat from the cylinder head via heat exchange with a circulated liquid coolant. Further, the cylinder head and integrated exhaust manifold include three exhaust passages at the exhaust exit port, rather than a single exhaust passage, which assists in distributing the thermal load at the exhaust exit port and reduces the temperature of the exhaust gas due to the three exhaust passages separating high pressure exhaust blowdown pulses.

However, the inventors herein have recognized issues with the above described approach. In one example, the multiple exhaust passages at the exit port results in vertical stacking of the exhaust passages (e.g., where one exhaust passage is positioned above another exhaust passage). This type of configuration prevents precise targeted cooling because the upper and lower cooling jackets do not provide coolant flow between the stacked exhaust passages, even if drilled passages are provided to fluidly couple the upper and lower cooling jackets at or near the exit port. This results in very high temperatures along the exhaust manifold, nearing and including the turbocharger mounting surface, that may exceed design limits of the cylinder head. In addition, the temperatures will result in difficulty sealing, a tendency to crack, and excessive temperature transfer to the turbocharger flange. Further, the stacked exhaust passages present challenges for coolant vapor management, as degas is difficult to package for communicating to all the cooling jackets through one degas port. The resulting vapor entrapment may cause local boiling if the vapor cannot be removed with the flow of the coolant.

As such, various example systems and approaches to address the above issues are described herein. In one example, an exhaust manifold for an engine includes a plurality of exhaust runners coupling a plurality of cylinder exhaust ports to an exhaust exit port, the plurality of exhaust runners forming at least a first exhaust passage and a second exhaust passage at the exhaust exit port; an upper cooling jacket positioned vertically above the first exhaust passage; a lower cooling jacket positioned vertically below the second exhaust passage; and a central cooling jacket positioned vertically below the first exhaust passage and vertically above the second passage.

In this way, the central cooling jacket between the upper and lower cooling jackets allows precise targeting and velocity control of coolant flow to where the coolant flow is needed over a larger surface area of direct contact to the exhaust passages. The temperatures in the previous high temperature locations are lowered and below the design limits of the cylinder head. In addition, the central cooling jacket may provide access for a drilled degas connection to work more beneficially to the system. In doing so, the risk of cracking in areas that are known as hot and difficult to cool areas may be reduced. Further, cylinder head total coolant flow demand may be decreased, allowing for a reduction in coolant pump size, and downstream exhaust component (e.g., catalyst, turbocharger) life may be extended by limiting the temperature of the exhaust gas exiting the exhaust manifold.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIGS. 12A-12C show rates of coolant flow across portions of the cooling jacket cores.

FIGS. 2-12C are shown approximately to scale, although other relative dimensions could be used.

DETAILED DESCRIPTION

Figure 1:
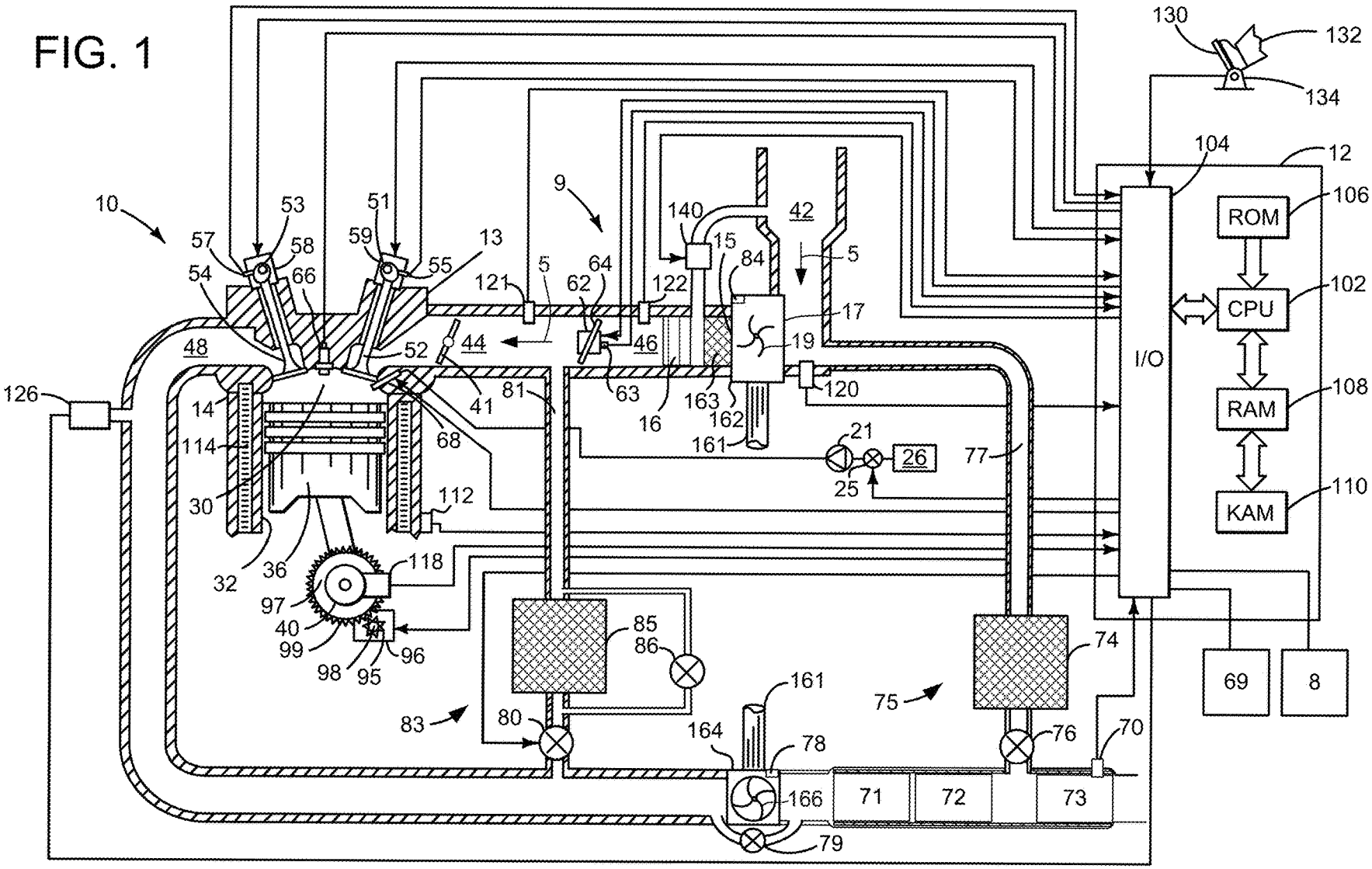
FIG. 1 schematically shows an example engine with an exhaust system.
Figure 7:
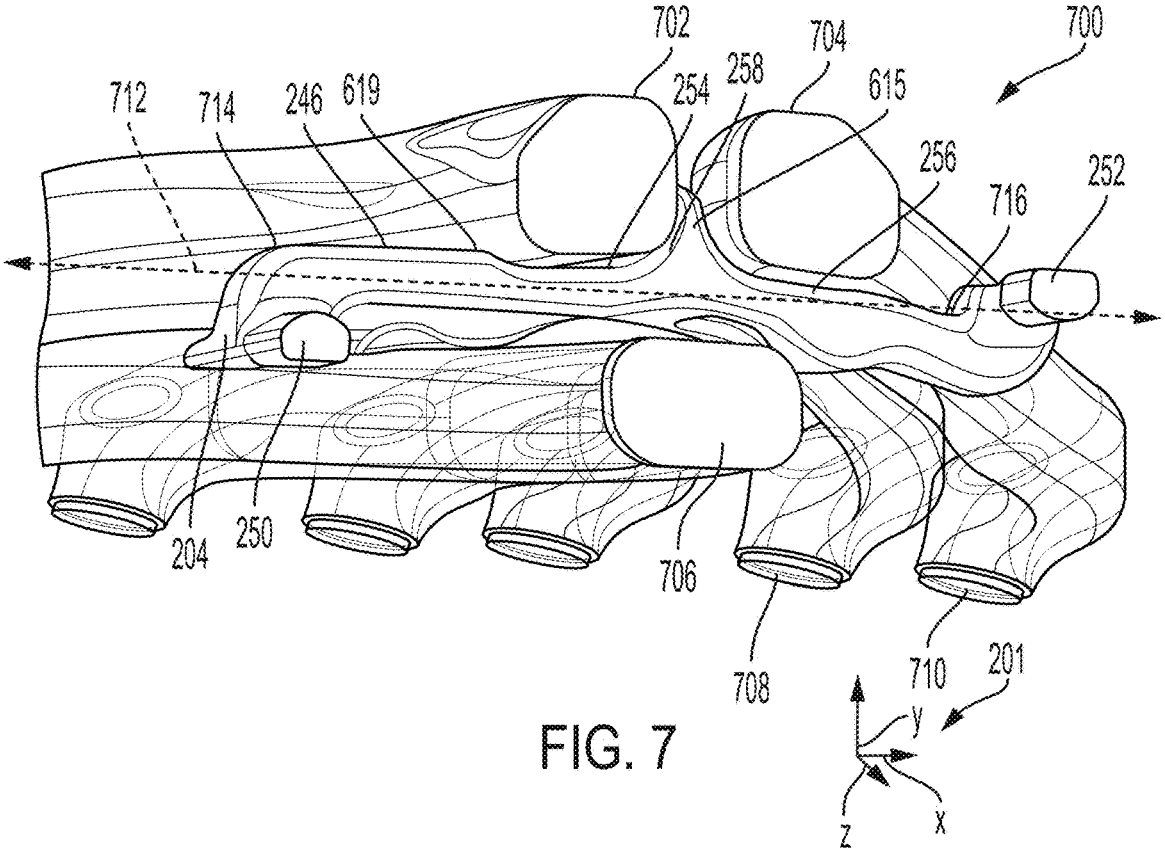
FIGS. 7-8 show perspective views of the central cooling jacket core of FIGS. 2-6D situated between three exhaust passage cores for casting of the integrated exhaust manifold.
Figure 8:
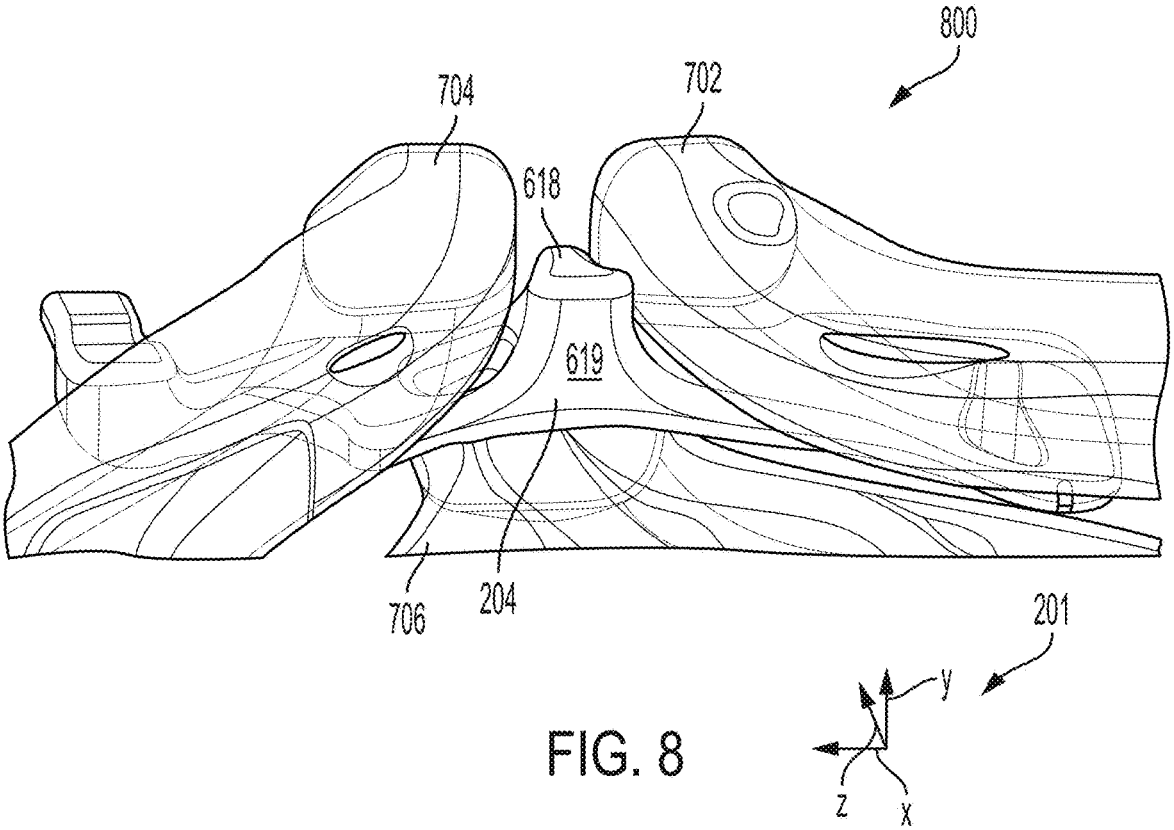
Figure 9:
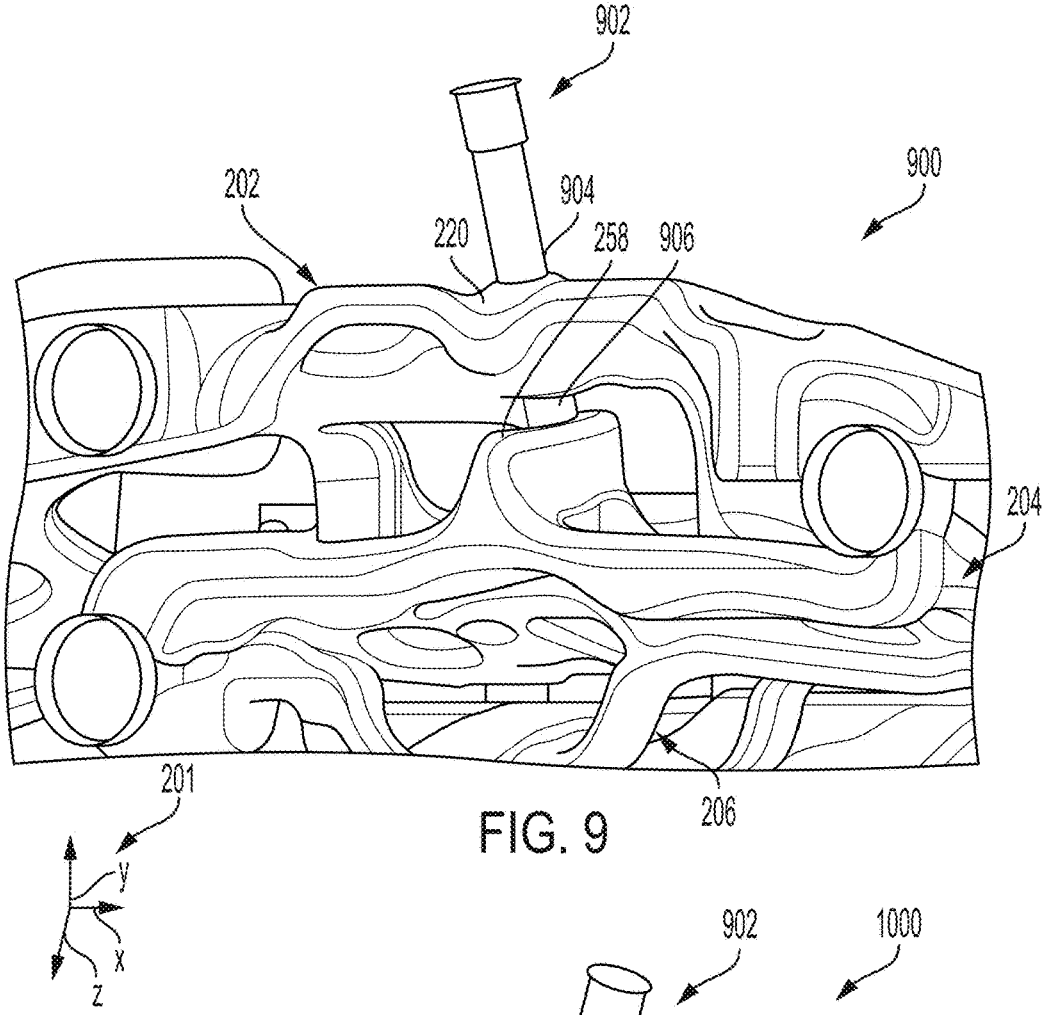
FIGS. 9-10 show perspective views of the cooling jacket cores and a drilled passage terminating at a degas port of the integrated exhaust manifold.
Figure 10:
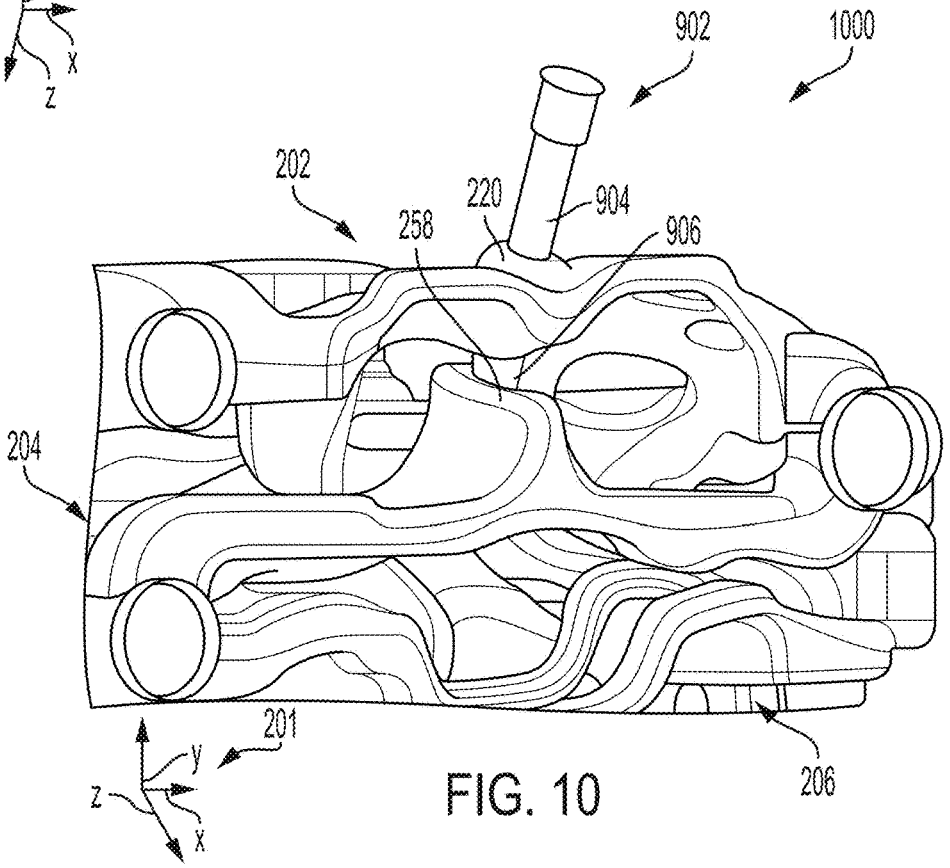
Figure 11:
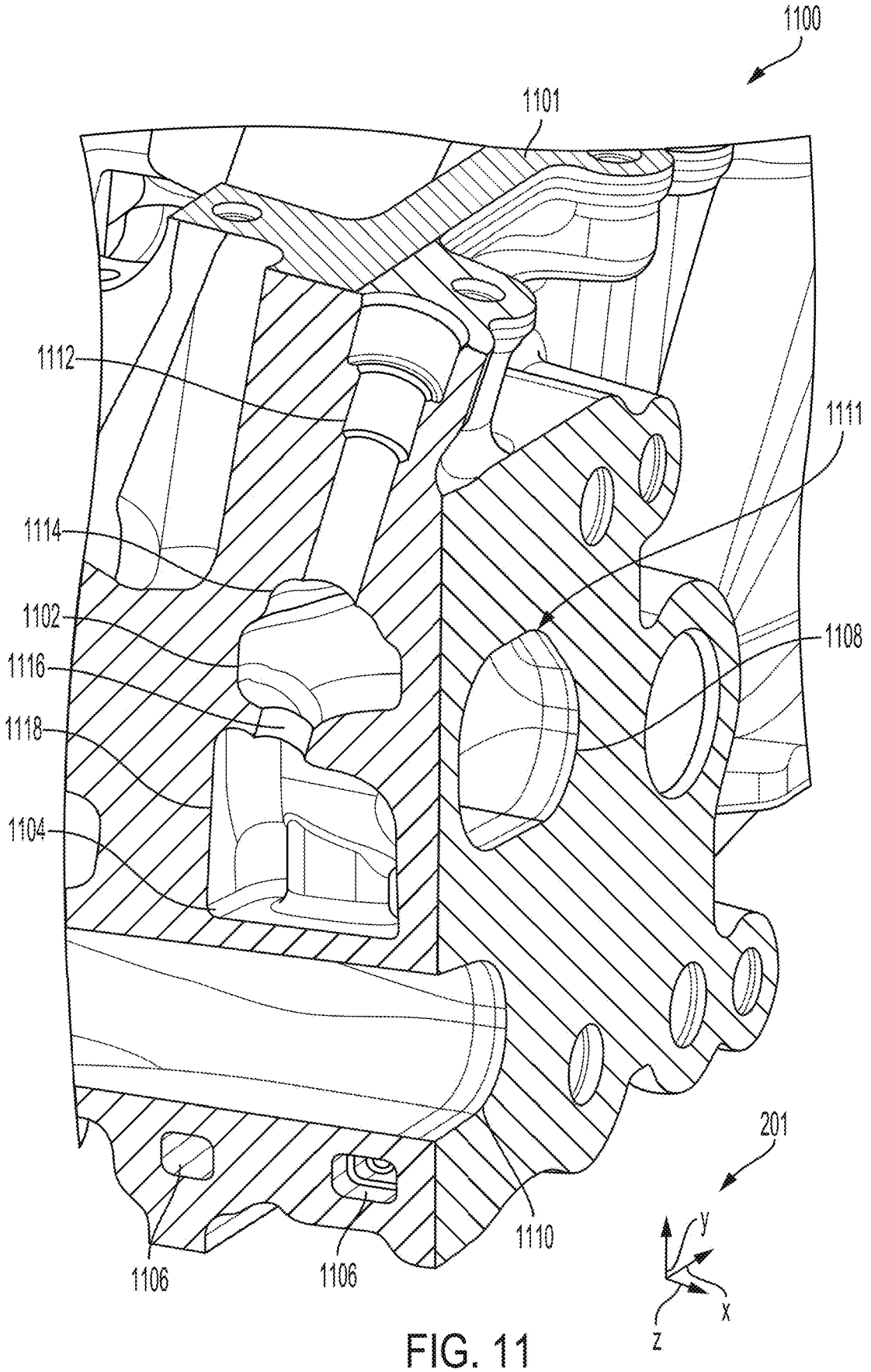
FIG. 11 shows a cross section of the cooling jackets and the drilled passage of the integrated exhaust manifold.
Figure 13:
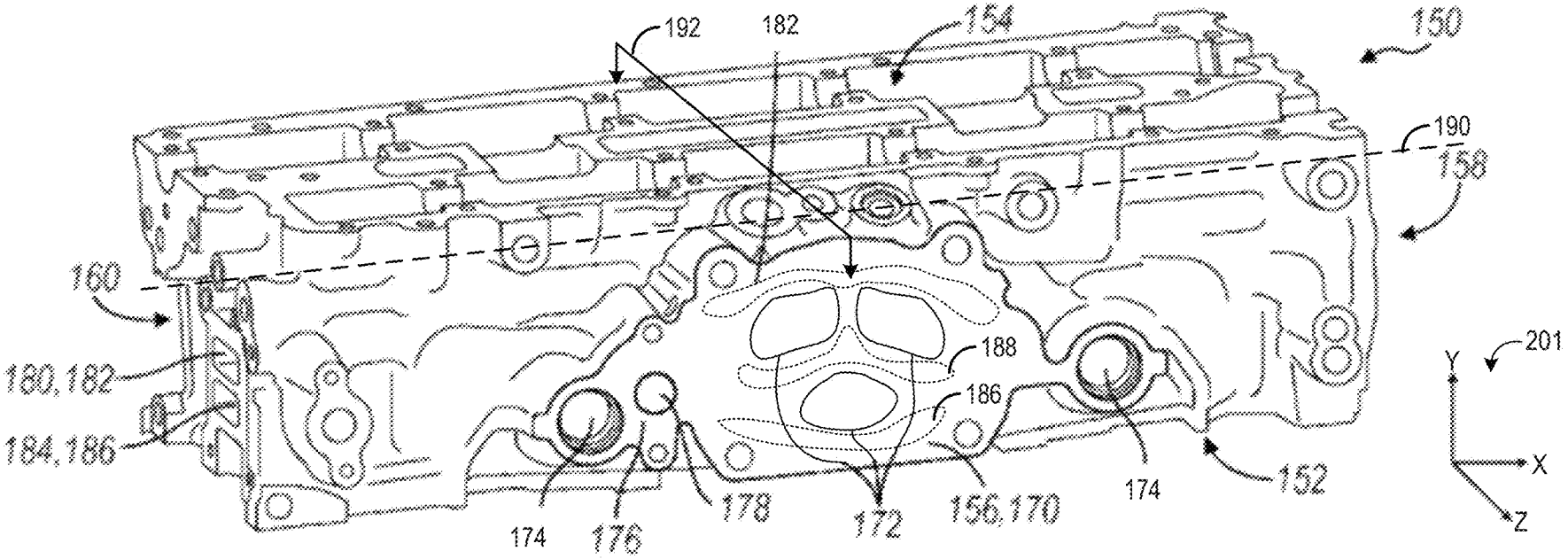
FIG. 13 shows an example cylinder head including the integrated exhaust manifold.

The following description relates to an exhaust system of a vehicle, such as the vehicle shown in FIG. 1. The exhaust system includes an integrated exhaust manifold, comprising three exhaust passages, integrated in a cylinder head, as shown in FIG. 13. The exhaust passages may be arranged in close proximity, with narrow spaces between. The integrated exhaust manifold may include an upper cooling jacket positioned on the vertical top of the exhaust passages and a lower cooling jacket positioned on the vertical bottom of the exhaust passages. A central cooling jacket may be positioned between the upper cooling jacket and the lower cooling jacket, as shown in FIGS. 2-6D, and positioned between the exhaust passages of the integrated exhaust manifold, as shown in FIGS. 7-8. The central cooling jacket and the upper cooling jacket may be fluidly coupled by a drilled passage leading to a degas port to vent coolant gasses, as shown in FIGS. 9-11.

Figure 12C:
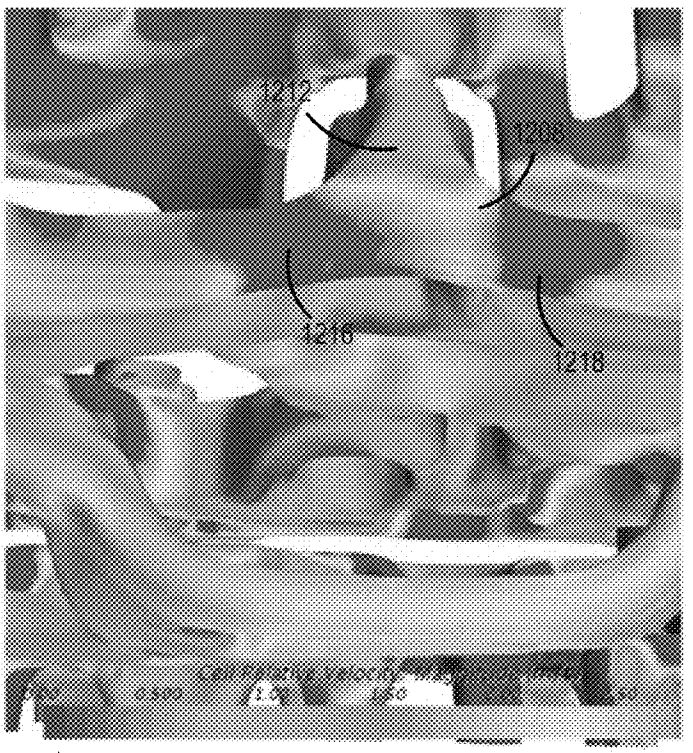
Figure 12B:
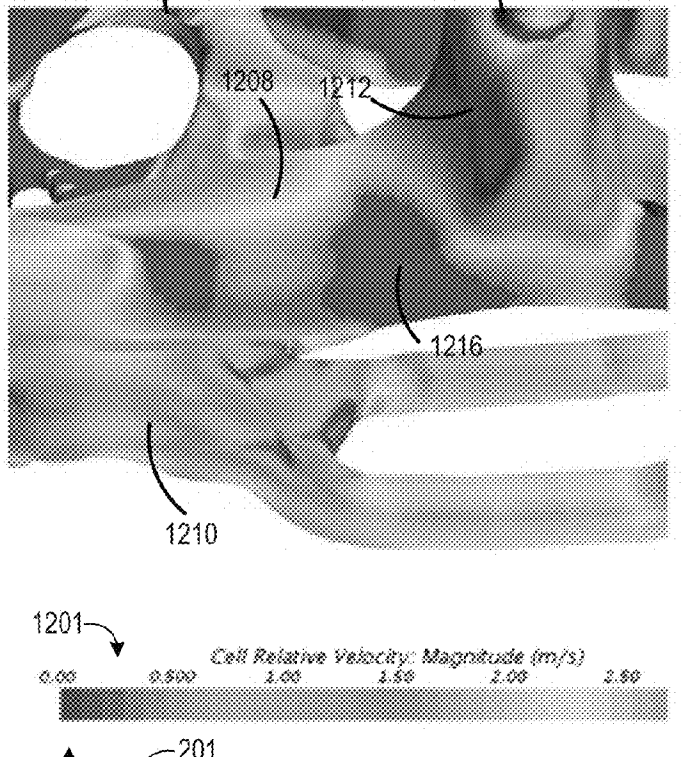

The upper cooling jacket and the lower cooling jacket of the integrated exhaust manifold may enable cooling on the top and bottom of the exhaust passages, while the central cooling jacket, positioned between the top exhaust passages and the bottom exhaust passage, may enable cooling of areas not cooled by the upper cooling jacket and lower cooling jacket alone. The upper, central, and lower cooling jackets may be configured to provide targeted flow of coolant at different velocities to provide desired cooling, as shown by FIGS. 12A-12C.

Referring to FIG. 1, internal combustion engine 10, comprising a plurality of cylinders, one cylinder of which is shown in FIG. 1, is controlled by electronic engine controller 12. The controller 12 receives signals from the various sensors of FIG. 1. Controller 12 employs the various actuators of FIG. 1 to adjust engine operation based on the received signals and instructions stored on a memory of the controller.

Engine 10 includes combustion chamber 30 and cylinder walls 32 with piston 36 positioned therein and connected to crankshaft 40. Cylinder head 13 is fastened to engine block 14. Combustion chamber 30 is shown communicating with intake manifold 44 and exhaust manifold 48 via respective intake valve 52 and exhaust valve 54. Each intake and exhaust valve may be operated by an intake cam actuation system 59 and an exhaust cam actuation system 58, respectively.

Cam actuation systems 58 and 59 each include one or more cams (such as intake cam 51 and exhaust cam 53) mounted on one or more camshafts and may utilize one or more of cam profile switching (CPS), variable cam timing (VCT), variable valve timing (VVT) and/or variable valve lift (VVL) systems (for example continuously variable valve lift, or CVVL) that may be operated by controller 12 to vary valve operation. In one example, actuation of variable valve timing and variable valve lift may be enabled by hydro-electric valve trains, such as a first electro-hydraulic valve train (not shown) that leverages pressure provided by a hydraulic medium to continuously regulate lifting of the intake valve 52. The first electro-hydraulic valve train may be positioned between the cam 51 and the intake valve 52 and operate either synchronized with or independently of the cam. The first electro-hydraulic valve train may include a higher pressure circuit and a lower pressure circuit coupled to cam actuation system 59 and used to control hydraulic pressure in the first electro-hydraulic valve train. A similar second electro-hydraulic valve train may be relied upon in similar fashion for controlling actuation of variable valve timing and variable valve lift for exhaust valve 54. While depicted as cam-actuated, in other examples the intake and/or exhaust valve(s) may be electronically actuated.

The angular position of intake and exhaust camshafts may be determined by position sensors 55 and 57, respectively. In alternative embodiments, one or more additional intake valves and/or exhaust valves of the cylinder may be controlled via electric valve actuation. For example, cylinder 30 may include one or more additional intake valves controlled via electric valve actuation and one or more additional exhaust valves controlled via electric valve actuation.

Fuel injector 68 is shown positioned in cylinder head 13 to inject fuel directly into combustion chamber 30, which is known to those skilled in the art as direct injection. Fuel is delivered to fuel injector 68 by a fuel system including a fuel tank 26, fuel pump 21, fuel pump control valve 25, and fuel rail (not shown). Fuel pressure delivered by the fuel system may be adjusted by varying a position valve regulating flow to a fuel pump (not shown). In addition, a metering valve may be located in or near the fuel rail for closed loop fuel control. A pump metering valve may also regulate fuel flow to the fuel pump, thereby reducing fuel pumped to a high pressure fuel pump.

Engine air intake system 9 includes intake manifold 44, throttle 62, grid heater 16, charge air cooler 163, turbocharger compressor 162, and intake plenum 42. Intake manifold 44 is shown communicating with optional electronic throttle 62 which adjusts a position of throttle plate 64 to control air flow from intake boost chamber 46. Compressor 162 draws air from air intake plenum 42 to supply boost chamber 46. Compressor vane actuator 84 adjusts a position of compressor vanes 19. Exhaust gases spin turbine 164 which is coupled to turbocharger compressor 162 via shaft 161. In some examples, a charge air cooler 163 may be provided. Further, an optional grid heater 16 may be provided to warm air entering cylinder 30 when engine 10 is being cold started. Compressor speed may be adjusted via adjusting a position of turbine variable vane control actuator 78 or compressor recirculation valve 140. In alternative examples, a waste gate 79 may replace or be used in addition to turbine variable vane control actuator 78. Turbine variable vane control actuator 78 adjusts a position of variable geometry turbine vanes 166. Exhaust gases can pass through turbine 164 supplying little energy to rotate turbine 164 when vanes are in an open position. Exhaust gases can pass through turbine 164 and impart increased force on turbine 164 when vanes are in a closed position. Alternatively, wastegate 79 or a bypass valve may allow exhaust gases to flow around turbine 164 so as to reduce the amount of energy supplied to the turbine. Compressor recirculation valve 158 allows compressed air at the outlet 15 of compressor 162 to be returned to the inlet 17 of compressor 162. Alternatively, a position of compressor variable vane actuator 78 may be adjusted to change the efficiency of compressor 162. In this way, the efficiency of compressor 162 may be reduced so as to affect the flow of compressor 162 and reduce the possibility of compressor surge. Further, by returning air back to the inlet of compressor 162, work performed on the air may be increased, thereby increasing the temperature of the air. Optional electric machine 165 is also shown coupled to shaft 161. Air flows into engine 10 in the direction of arrows 5. In some examples, a swirl valve 41 may be included and controlled by controller 12 to adjust the swirl/motion of the intake air before entering cylinder 30.

Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99 such that starter 96 may rotate crankshaft 40 during engine cranking. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. An engine start may be requested via human/machine interface (e.g., key switch, pushbutton, remote radio frequency emitting device, etc.) 69 or in response to vehicle operating conditions (e.g., brake pedal position, accelerator pedal position, battery SOC, etc.). Battery 8 may supply electrical power to starter 96. Controller 12 may monitor battery state of charge.

Combustion is initiated in the combustion chamber 30 when fuel automatically ignites via combustion chamber temperatures reaching the auto-ignition temperature of the fuel that is injected to cylinder 30. The temperature in the cylinder increases as piston 36 approaches top-dead-center compression stroke. In some examples, a universal Exhaust Gas Oxygen (UEGO) sensor 126 may be coupled to exhaust manifold 48 upstream of emissions device 71. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures optional glow plug 66 may convert electrical energy into thermal energy so as to create a hot spot next to one of the fuel spray cones of an injector in the combustion chamber 30. By creating the hot spot in the combustion chamber next to the fuel spray, it may be easier to ignite the fuel spray plume in the cylinder, releasing heat that propagates throughout the cylinder, raising the temperature in the combustion chamber, and improving combustion. Cylinder pressure may be measured via optional pressure sensor 67, alternatively or in addition, sensor 67 may also sense cylinder temperature.

Emissions device 71 can include an oxidation catalyst and it may be followed by a diesel particulate filter (DPF) 72 and a selective catalytic reduction (SCR) catalyst 73, in one example. In another example, DPF 72 may be positioned downstream of SCR 73. Temperature sensor 70 provides an indication of SCR temperature.

Exhaust gas recirculation (EGR) may be provided to the engine via high pressure EGR system 83. High pressure EGR system 83 includes valve 80, EGR passage 81, and EGR cooler 85. EGR valve 80 is a valve that closes or allows exhaust gas to flow from upstream of emissions device 71 to a location in the engine air intake system downstream of compressor 162. EGR may be cooled via passing through EGR cooler 85. EGR may bypass the EGR cooler 85 via a bypass passage coupled around the EGR cooler 85 and controlled by an EGR cooler bypass valve 86. EGR may also be provided via low pressure EGR system 75. Low pressure EGR system 75 includes EGR passage 77 and EGR valve 76. Low pressure EGR may flow from downstream of emissions device 71 to a location upstream of compressor 162. Low pressure EGR system 75 may include an EGR cooler 74, which in some examples may also include a bypass passage and bypass valve.

Controller 12 is shown in FIG. 1 as a conventional microcomputer including: microprocessor unit 102, input/output ports 104, read-only memory (e.g., non-transitory memory) 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by human foot 132; a measurement of engine manifold pressure (MAP) from pressure sensor 121 coupled to intake manifold 44 (alternatively or in addition sensor 121 may sense intake manifold temperature); boost pressure from pressure sensor 122; exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 63. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle.

In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle. Further still, engine 10 is described herein as a diesel engine, but it is to be appreciated that the engine may be a gasoline engine (including a spark plug instead of a glow plug), a dual- or multi-fuel engine, an engine in a hybrid vehicle, etc.

FIG. 1 illustrates only one cylinder of engine 10, but it is to be appreciated that engine 10 includes a plurality of cylinders similar to cylinder 30. The cylinders of engine 10 may be formed by cylinder head 13 and cylinder block 14. In some examples, at least a portion of the exhaust passage 48 may be incorporated into an exhaust manifold that is integrated into the cylinder head. Each cylinder may include at least one exhaust port, where each exhaust port couples a respective cylinder to the exhaust manifold via an exhaust valve, such as exhaust valve 54, and each exhaust port may be coupled to a respective exhaust runner. The exhaust runners may merge at one or more locations to form one or more exhaust passages that exit the exhaust manifold/cylinder head at an exit port. As explained in more detail below, the cylinder head may include a plurality of cooling jackets configured to flow coolant in order to maintain the cylinder head at or below a target temperature. These cooling jackets may include cooling jackets positioned above and below the exhaust passages within the integrated exhaust manifold/cylinder head. Further, to target cooling to the exhaust passages, which may be prone to high temperatures, an additional cooling jacket may be provided in between the exhaust passages.

FIG. 13 illustrates an example cylinder head 150. The cylinder head 150 may be used with the engine 10 as illustrated in FIG. 1, and thus is a non-limiting example of cylinder head 13. The cylinder head 150 as illustrated is configured for use with an in-line turbocharged engine with exhaust gas recirculation. The cylinder head 150 may be reconfigured for use with other engines, for example a naturally aspirated engine, or engine with other numbers of cylinders, and remain within the spirit and scope of the disclosure. The cylinder head 150 may be formed from a number of materials, including iron and ferrous alloys, aluminum and aluminum alloys, other metal alloys, composite materials, and the like. In one example, the cylinder head 150 is cast from aluminum or an aluminum alloy and uses various dies, sand cores and/or lost cores to provide the various gas and fluid passages within the head. Additionally, passages may be formed within the head via various machining processes, for example, by drilling, after the casting process.

The cylinder head has a deck face 152 or deck side that is configured to mate with a head gasket and the deck face of a corresponding cylinder block to form the engine block. Opposed from the deck face 152 is a top face, side, or surface 154. A first side of the cylinder head, referred to as an exhaust side 156, provides mounting features for mounting one or more components of an exhaust system. Another side (not shown) is opposed to the exhaust side 156, provides mounting features for the intake manifold of the engine. The cylinder head 150 also has first and second opposed ends 158, 160. Although the faces are shown as being generally perpendicular to one another, other orientations are possible, and the faces may be oriented differently relative to one another to form the head 150.

The exhaust side 156 of the head 150 has an exhaust mounting face 170 for an external exhaust manifold or other exhaust conduit to direct exhaust gases to a turbocharger, an aftertreatment device, or the like. In one example, the turbocharger itself is mounted to the mounting face 170. The cylinder head 150 as shown has an integrated exhaust manifold with three exhaust passages 172, although any number of exhaust passages from the head 150 is contemplated. The three exhaust passages 172 form an exit port at the exhaust mounting face 170.

The exhaust side 156 of the head 150 also has a mounting face 176 for an EGR cooler or a conduit to direct EGR gases to the EGR cooler. The mounting face 176 defines an EGR port 178. The EGR gases are diverted from the exhaust gas stream within the head 150. The mounting faces 170, 176 are illustrated as being co-planar and a continuous surface.

The cylinder head 150 has a fluid jacket formed within and integrated into the head 150, for example, during a casting or molding process. The fluid jacket may be a cooling jacket, as described herein for flow of coolant therethrough.

In the cylinder head 150 as shown, there are three cooling jackets within the cylinder head 150. An inlet or outlet port 180 is illustrated for an upper cooling jacket 182. An inlet or an outlet port 184 is also illustrated for a lower cooling jacket 186. The cooling jackets 182, 186 may be in fluid communication with one another inside the cylinder head 150 as described below. The cylinder head 150 further includes a central cooling jacket 188 positioned intermediate the upper cooling jacket 182 and the lower cooling jacket 186. FIG. 13 shows each of the upper cooling jacket 182, the central cooling jacket 188, and the lower cooling jacket 186 schematically (in dashed lines) at the exhaust mounting face 170, in order to show the positioning of each cooling jacket relative to the three exhaust passages 172. However, the dashed lines are intended to represent the positioning of the cooling jackets within the cylinder head and it is to be understood that the cooling jackets are not present on the actual exhaust mounting face 170, but rather are positioned within the cylinder head 150, proximate to and facing the exhaust mounting face 170.

The cylinder head 150 has a longitudinal axis 190 that may correspond with the longitudinal axis of the engine and may be parallel to the x axis shown in the Cartesian coordinate system 201, a lateral or transverse axis (parallel to the z axis of the coordinate system 201), and a vertical or normal axis (parallel to the y axis of the coordinate system 201). The normal axis may be aligned with a gravitational force on the head 150 when the head is installed on a vehicle and the vehicle is on a flat driving surface, although other orientations are possible.

FIG. 13 also shows two locating features 174, which may be used to locate core(s) during the casting process, and are subsequently plugged in a finished cylinder head 150. The locating features 174 may be positioned differently than shown in FIG. 13, including more or fewer locating features, without departing from the scope of this disclosure.

FIGS. 2-5 show a set of cooling jacket cores 200, including an upper cooling jacket core 202, a central cooling jacket core 204, and a lower cooling jacket core 206, which may be used to form a set of cooling jackets in an integrated exhaust manifold. For example, the upper cooling jacket core 202 may be used to form an upper cooling jacket (such as upper cooling jacket 182), the central cooling jacket core 204 may be used to form a central cooling jacket (such as central cooling jacket 188), and the lower cooling jacket core 206 may be used to form a lower cooling jacket (such as lower cooling jacket 186) for a cylinder head, such as cylinder head 150.

The set of cooling jacket cores 200 represent negative views of the cooling jackets within the cylinder head, and may represent the shape of sand cores or lost cores used in a casting process for the cylinder head. Thus, upper cooling jacket core 202, the central cooling jacket core 204, and the lower cooling jacket core 206 may be used during casting of the integrated exhaust manifold/cylinder head to provide hollow passages for fluid to flow through. The set of cooling jacket cores 200 may be removed after casting to leave a hollow space, in some examples. FIGS. 2-5 will be described in terms of the exhaust passages and cooling jackets and associated fluid passages that are formed within the cylinder head by the various cores.

The Cartesian coordinate system 201 is provided, including the x-axis corresponding to a longitudinal axis parallel to the ground, the z-axis corresponding to the lateral or transverse axis, parallel to ground and perpendicular to the x-axis, and the y-axis corresponding to the vertical or normal axis (e.g., parallel to the direction of gravity). The y-axis may be aligned with a gravitational force on the cooling jackets when the cylinder head is cast and installed on a vehicle and the vehicle is on a flat driving surface, although other orientations are possible.

Figure 2:
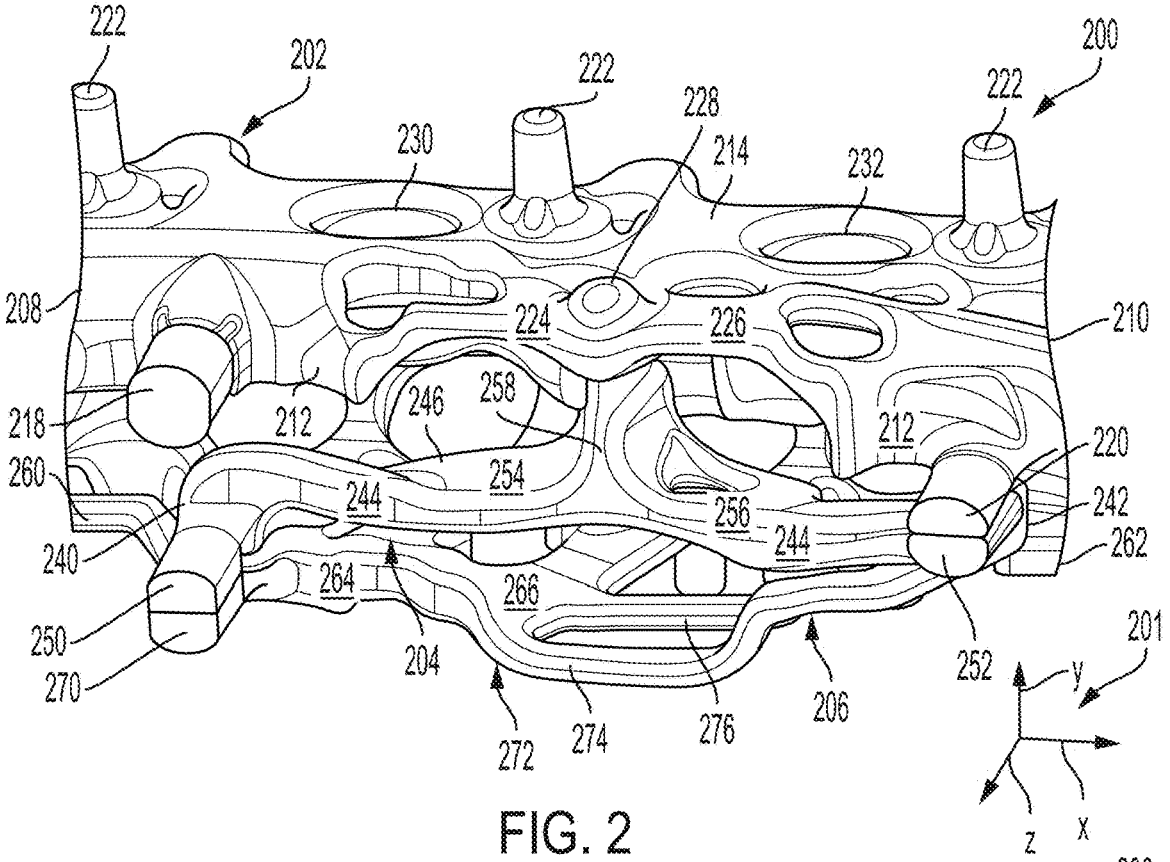
FIGS. 2-5 show perspective views of a set of cooling jacket cores used to cast an integrated exhaust manifold.
Figure 3:
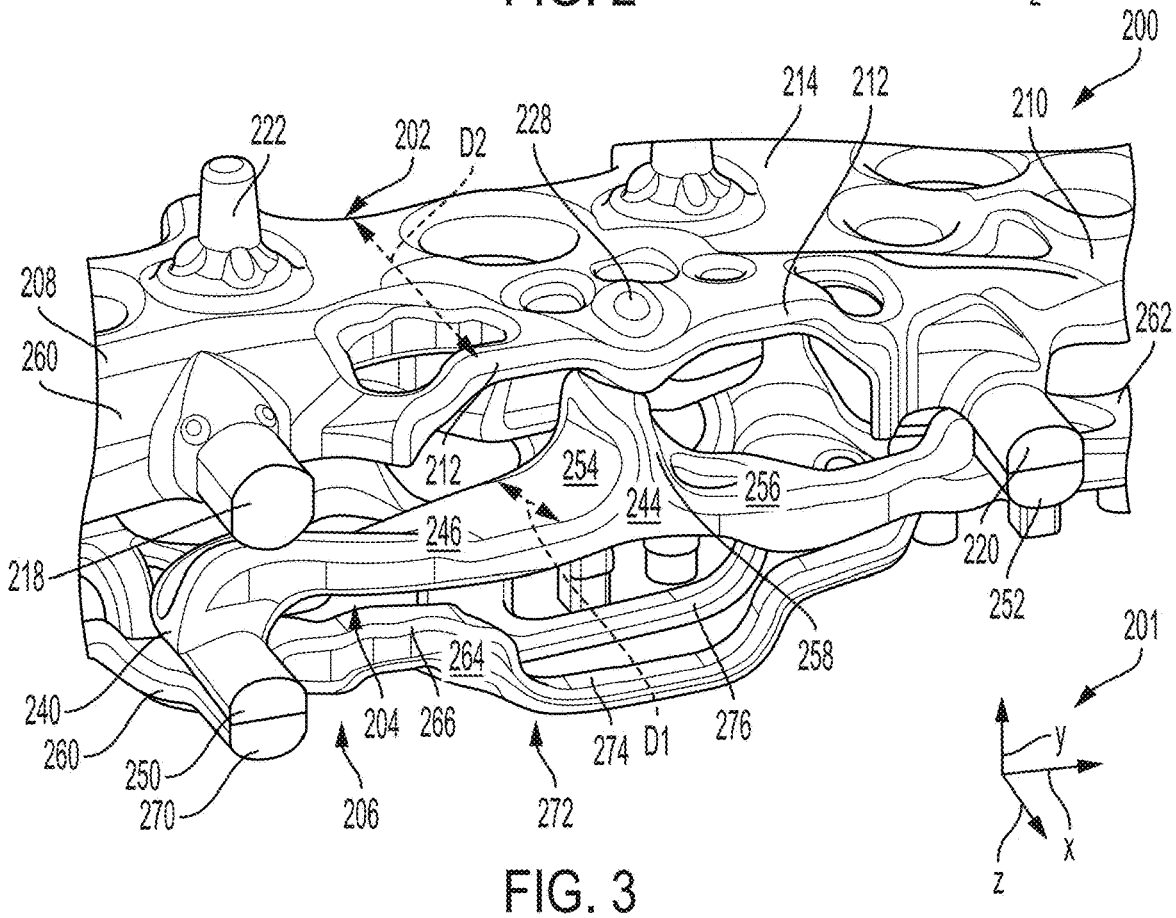
Figure 4:
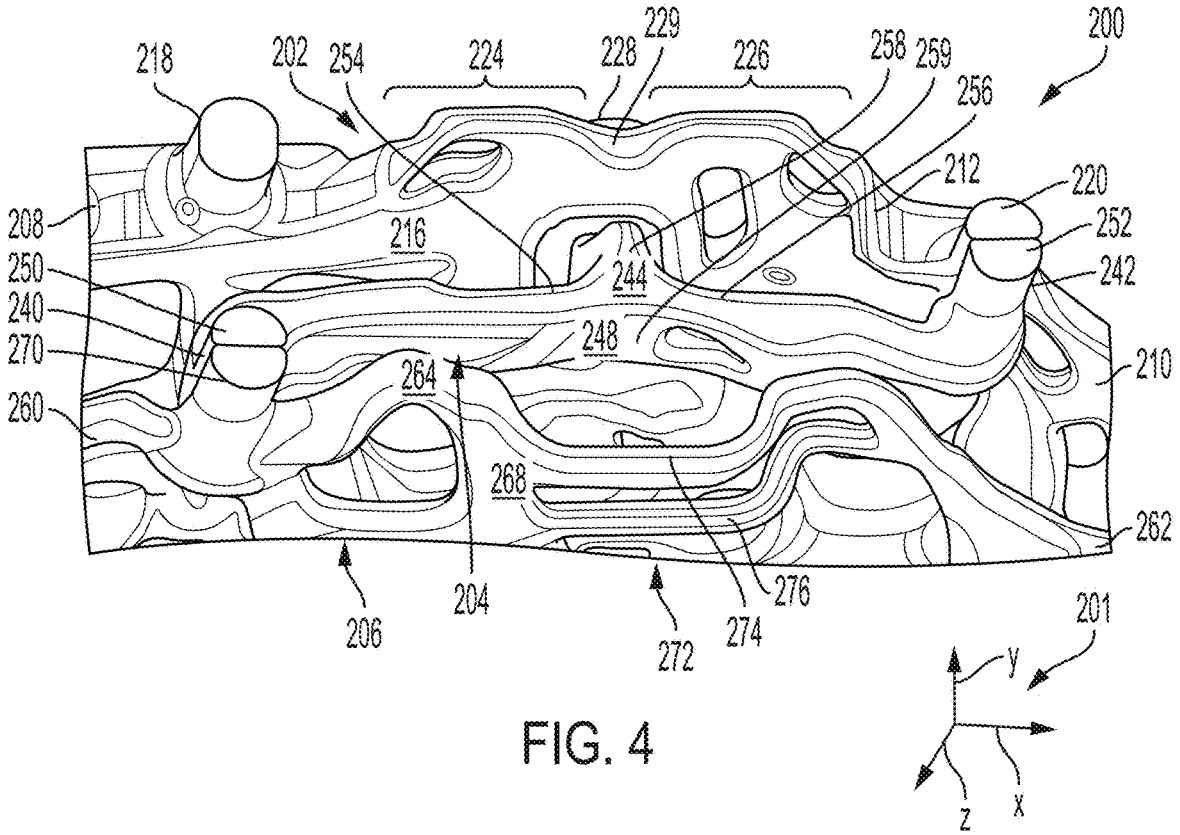
Figure 5:
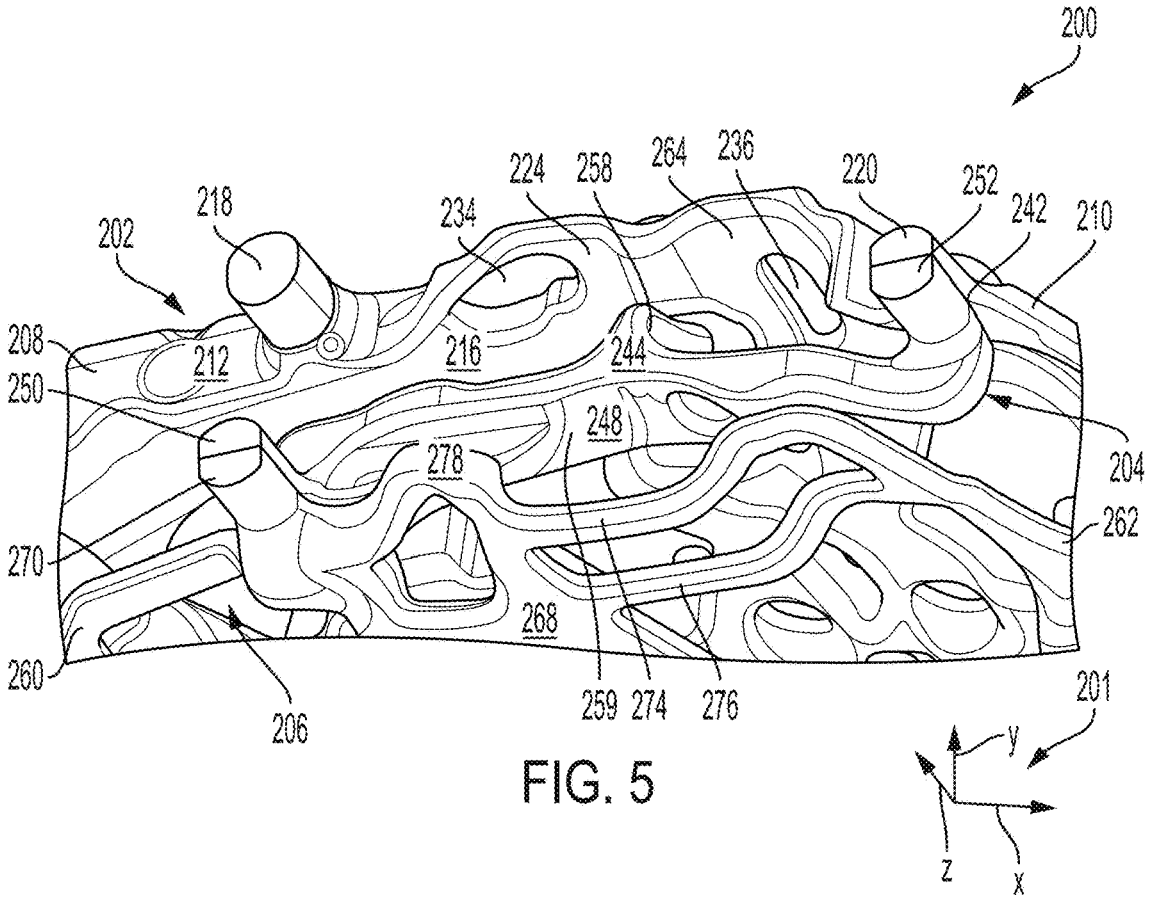

FIGS. 2-5 show different views of a front of the set of cooling jacket cores 200, where the front of the set of cooling jacket cores 200 may be defined as the side of the set of cooling jacket cores that is proximate to and faces the exhaust side of the cylinder head when the cores are used to cast the cylinder head. FIGS. 2 and 3 show a top perspective view of the front of the set of cooling jacket cores, as viewed from the right and from the left, respectively. FIGS. 4 and 5 show a bottom perspective view of the front of the set of cooling jacket cores, as viewed from the left and from the right, respectively. FIGS. 2-5 are described collectively.

The upper cooling jacket core 202 includes a first side 208, a second side 210 opposite the first side 208, a front face 212 extending from the first side 208 to the second side 210, a top side 214 extending from the first side 208 to the second side 210 and from the front face 212 to a rear face (not shown), and a bottom side 216 opposite the top side 214, also extending from the first side 208 to the second side 210 and from the front face 212 to the rear face. It is to be appreciated that in FIGS. 2-5, the sides of the upper and lower cooling jacket cores are not shown, so that the magnification of all the cores may be increased to provide visual focus to the central cooling jacket core 204. Thus, the terminating edges of the first side 208 and the second side 210 are not visible in FIGS. 2-5, and the first side 208 and the second side 210 are generally indicated to provide reference for describing the orientation of the upper cooling jacket core 202 and the positioning of other features of the upper cooling jacket core 202.

The front face 212 includes a first extension 218 at the first side 208 of the upper cooling jacket core 202. The first extension 218 may extend outward from the front face 212 of the upper cooling jacket core 202 along the z-axis of the Cartesian coordinate system 201 shown in FIG. 2. The upper cooling jacket core 202 also includes a second extension 220 at the second side 210 of the upper cooling jacket core 202, and the second extension 220 may extend outward from the front face 212 along the z-axis. The second extension 220 may have a bottom face that is configured to be positioned in face-sharing contact with a top face of a second extension 252 of the central cooling jacket core 204. After casting, the second extension 220 and the second extension 252 may form a fluidic coupling between the upper cooling jacket and the central cooling jacket.

The upper cooling jacket core 202 further includes a plurality of protrusions 222 that extend upward along the y-axis from the top side 214 of the upper cooling jacket core 202. These protrusions may allow gases to vent during the casting process. In other examples, the protrusions may form inlets, outlets, connections, etc. in the cast cylinder head.

The upper cooling jacket core 202 further includes a set of concave portions/surfaces that, after casting, form curved portions that are configured to at least partially surround an upper portion of a first exhaust passage and an upper portion of a second exhaust passage of the integrated exhaust manifold. As seen most clearly in FIGS. 4-5, the upper cooling jacket core 202 may comprise a first concave portion 224. The first concave portion 224 may form a coolant passage at least partially surrounding an upper portion of the first exhaust passage. The upper cooling jacket core 202 may include a second concave portion 226 that may form a coolant passage at least partially surrounding an upper portion of the second exhaust passage. The exhaust passage cores, which may provide exhaust gas passages once cast, may be seen in FIGS. 7 and 8. The front face 212 may curve upward to form the first concave portion 224, and then curve downward to form the second concave portion 226. The front face 212 may decrease in height at the first concave portion 224 and the second concave portion 226, relative to the areas of the front face on either side of the concave portions. The front face 212 may form a lip that overhangs the first concave portion 224 and the second concave portion 226, at least in some areas.

The upper cooling jacket core 202 may comprise an upper ridge 228, positioned between the first concave portion 224 and the second concave portion 226. The upper ridge 228 may comprise a protrusion curving upwards towards the midpoint between the first and second concave portions. When the cylinder head including the integrated exhaust manifold is cast, a bore for a degas port may be drilled through the upper ridge 228 and a central ridge 258 on the central cooling jacket core 204, fluidly connecting the central and upper cooling jackets. The front face 212, at the upper ridge 228, may form a v- or u-shaped dip 229 between the first and second concave portions, which may target coolant to the space between the first exhaust passage and the second exhaust passage.

The upper cooling jacket core 202 may include one or more voids, such as rear void 230, rear void 232, front void 234, and front void 236. Theses voids may be provided to accommodate a component of the cylinder head, provide structural support to the IEM, or to create flow paths for the coolant to more efficiently cool the IEM. For example, the rear voids 230 and 232 may accommodate components or structures of the cylinder head, such as exhaust valves. The front voids 234 and 236 may create flow paths within the cooling jacket that result in desired coolant flow velocity in desired areas, as described in more detail below with respect to FIGS. 12A-12C. The central cooling jacket core 204 is provided to create a central cooling jacket, extending between at least two vertically arranged exhaust passages. The central cooling jacket may be positioned vertically intermediate the upper cooling jacket and the lower cooling jacket, and thus in FIGS. 2-5, the central cooling jacket core 204 is positioned intermediate the upper cooling jacket core 202 and the lower cooling jacket core 206.

The central cooling jacket core 204 includes a first side 240, a second side 242 opposite the first side 240, a front face 244 extending from the first side 240 to the second side 242, a top side 246 extending from the first side 240 to the second side 242 and from the front face 244 to a rear face (not shown in FIGS. 2-5), and a bottom side 238, opposite the top side 246, extending from the first side 240 to the second side 242 and from the front face 244 to the rear face.

The central cooling jacket core 204 includes a first extension 250 on the first side 240 and a second extension 252 on the second side 242. The first extension 250 and the second extension 252 may each extend outward from the front face 244 of the central cooling jacket core 204 along the z-axis of the Cartesian coordinate system 201 shown in FIG. 2. As explained above, the second extension 252 is in face-sharing contact with the second extension 220 of the upper cooling jacket core 202 to form a first fluidic coupling between the central cooling jacket and the upper cooling jacket. The first extension 250 likewise has a bottom face that is in face-sharing contact with a top face of a first extension 270 of the lower cooling jacket core 206, and after casting, the first extension 250 of the central cooling jacket core 204 and the first extension 270 of the lower cooling jacket core 206 may form a second fluidic coupling between the central cooling jacket and the lower cooling jacket. In some examples, coolant may enter the central cooling jacket via the second fluidic coupling (e.g., at the first side 240) and exit the central cooling jacket via the first fluidic coupling (e.g., at the second side 242), though other coolant flow directions are possible without departing from the scope of this disclosure. The central cooling jacket is maintained fluidly separate from the lower cooling jacket along an entirety of the central cooling jacket other than at the second fluidic coupling. Further, the central cooling jacket is also maintained fluidly separate from the upper cooling jacket along an entirety of the central cooling jacket other than at the first fluidic coupling and at a connection to a degas port (described in more detail below).

The central cooling jacket core 204 includes a first concave portion 254. The first concave portion 254 may form a coolant passage at least partially surrounding a lower portion of the first exhaust passage. The central cooling jacket core 204 may include a second concave portion 256 that may form a coolant passage at least partially surrounding a lower portion of the second exhaust passage. The front face 244 and the top side 246 may curve slightly downward and then upward to form the first concave portion 254, and then curve downward and slightly upward again to form the second concave portion 256. Collectively, the first concave portion 224 of the upper cooling jacket core 202 and the first concave portion 254 of the central cooling jacket core 204 form a first channel that, after casting, surrounds the first exhaust passage. The second concave portion 226 of the upper cooling jacket core 202 and the second concave portion 256 of the central cooling jacket core 204 form a second channel that, after casting, surrounds the second exhaust passage.

As mentioned previously, the central cooling jacket core 204 may comprise a central ridge 258 between the first concave portion 254 and the second concave portion 256. The central ridge 258 may form the vertically-highest portion of the central cooling jacket core 204 and forms a ridge in the central cooling jacket between the first exhaust passage and the second exhaust passage, thereby targeting coolant to the area between the exhaust passages. Further, the central ridge 258 may be fluidly coupled to a drilled passage terminating at a degas port, so that the ridge of the central cooling jacket is fluidly coupled to a degas bottle of the engine cooling system. In this way, vaporized coolant that may collect at the ridge (e.g., because the ridge is the vertically-highest portion of the central cooling jacket) may be transported to the degas bottle.

The central cooling jacket core 204 includes a third concave portion 259. The third concave portion 259 may form a coolant passage at least partially surrounding an upper portion of the third exhaust passage. The front face 244 and the bottom side 248 may curve upward and then downward to form the third concave portion 259. As will be explained below, the third concave portion 259 may form a third channel with the lower cooling jacket core 206 to accommodate the third exhaust passage.

As appreciated from FIGS. 2-5, the first and second concave portions of the upper cooling jacket core 202 may curve in an upward manner, such that a midpoint of each of the first and second concave portions is a vertically highest portion of each respective concave portion. Likewise, the third concave portion of the central cooling jacket core 204 may curve in an upward manner, such that a midpoint of the third concave portion is a vertically highest portion of the third concave portion. In contrast, the first and second concave portions of the central cooling jacket core 204 curve in a downward manner, such that a midpoint of each of the first and second concave portions of the central cooling jacket core 204 is a vertically lowest portion of each respective concave portion.

The central cooling jacket core 204 includes various voids, lips, projections, and curved surfaces to provide targeted coolant flow within the central cooling jacket. Additional details about the central cooling jacket core 204 are provided below with respect to FIGS. 6A-6D.

The lower cooling jacket core 206 includes a first side 260, a second side 262 opposite the first side 260, a front face 264 extending from the first side 260 to the second side 262, a top side 266 extending from the first side 260 to the second side 262 and from the front face 264 to a rear face (not shown), and a bottom side 268 opposite the top side 266, also extending from the first side 260 to the second side 262 and from the front face 264 to the rear face. It is to be appreciated that in FIGS. 2-5, the sides of the upper and lower cooling jacket cores are not shown, so that the magnification of all the cores may be increased to provide visual focus to the central cooling jacket core 204. Thus, the terminating edges of the first side 260 and the second side 262 are not visible in FIGS. 2-5, and the first side 260 and the second side 262 are generally indicated to provide reference for describing the orientation of the lower cooling jacket core 206 and the positioning of other features of the lower cooling jacket core 206.

The front face 264 includes a first extension 270 at the first side 260 of the lower cooling jacket core 206. The first extension 270 may extend outward from the front face 264 of the lower cooling jacket core 206 along the z-axis. The first extension 270 may have a top face that is configured to be positioned in face-sharing contact with the bottom face of the first extension 250 of the central cooling jacket core 204. After casting, the first extension 250 and the first extension 270 may form the second fluidic coupling between the central cooling jacket and the lower cooling jacket, as previously described.

The lower cooling jacket core 206 includes a first concave portion 272. The first concave portion 272 may form a coolant passage at least partially surrounding a lower portion of the third exhaust passage. The front face 264 and the top side 266 may curve downward and then upward to form the first concave portion 272. The third concave portion 259 of the central cooling jacket core 204 and the first concave portion 272 of the lower cooling jacket core 206 may collectively form the third channel to accommodate the third exhaust passage.

The lower cooling jacket core 206 may include a plurality of voids to allow for channels or other features in the lower cooling jacket, for accommodating components of the cylinder head (e.g., the cylinder bores). Further, the voids may facilitate coolant flow through the lower cooling jacket at one or more desired flow rates. The lower cooling jacket core 206 may also include, at the first concave portion 272, a bifurcated region where the lower cooling jacket core 206 splits into two parallel arms, e.g., a first arm 274 and a second arm 276. Each of the first arm 274 and the second arm 276 may be curved in the downward, concave manner to form the first concave portion 272.

In some examples, positioning of the extensions of the central cooling jacket core 204 may be flipped vertically so that the first extension 250 is in face-sharing contact with an extension on the upper cooling jacket core 202 (e.g., extension 218) rather than the lower cooling jacket core 206 and the second extension 252 is in face-sharing contact with an extension on the second side of the lower cooling jacket core 206 rather than the upper cooling jacket core 202. In this flipped orientation, the first extension 270 may be eliminated and an additional extension may be present on the second side of the upper cooling jacket core 202. In still other examples, the extensions on the central cooling jacket core 204 may be in face-sharing contact with extensions on only the upper cooling jacket core 202 (thereby creating fluidic couplings between the central cooling jacket and the upper cooling jacket, but not with the lower cooling jacket) or the extensions on the central cooling jacket core 204 may be in face-sharing contact with extensions on only the lower cooling jacket core 206 (thereby creating fluidic couplings between the central cooling jacket and the lower cooling jacket, but not with the upper cooling jacket).

Figure 6A:
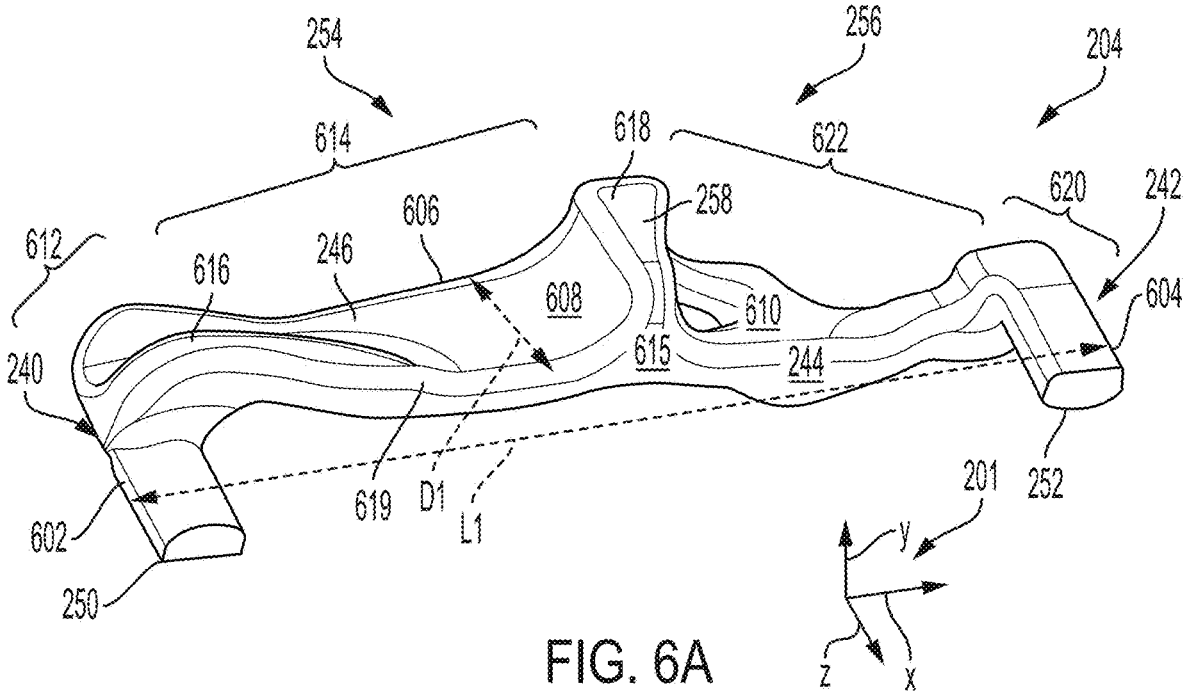
FIGS. 6A-6D show perspective views of a central cooling jacket core of the cooling jacket cores from FIGS. 2-5.
Figure 6B:
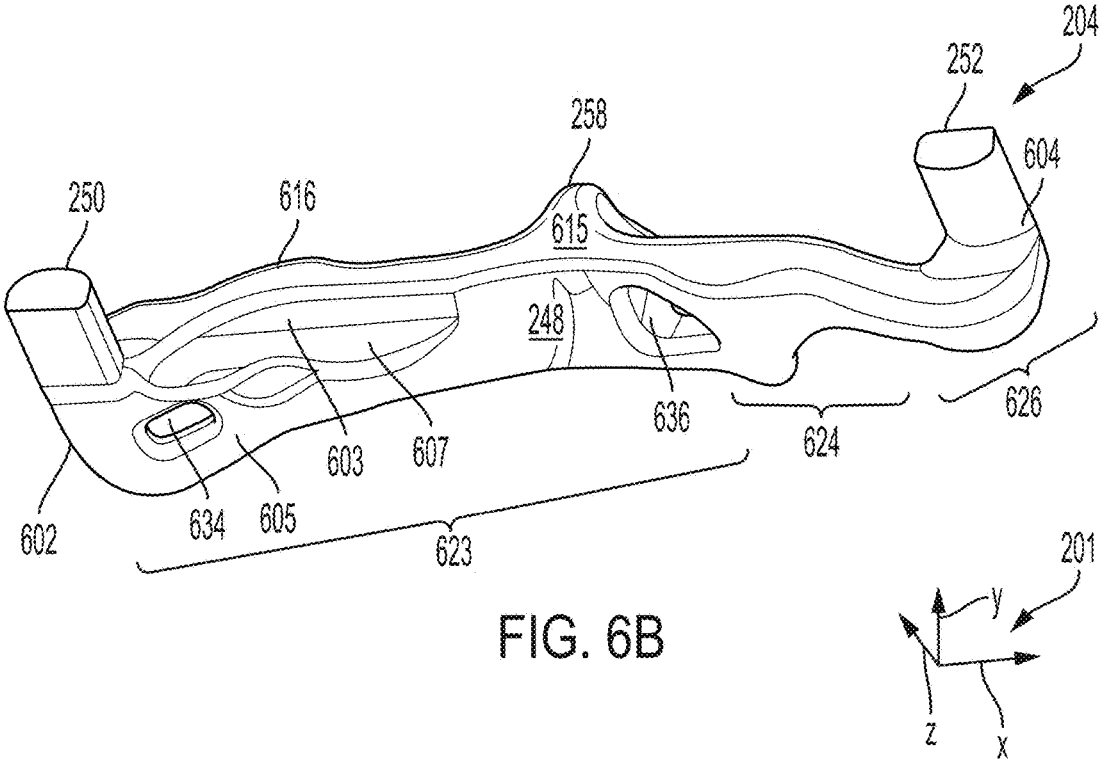
Figure 6C:
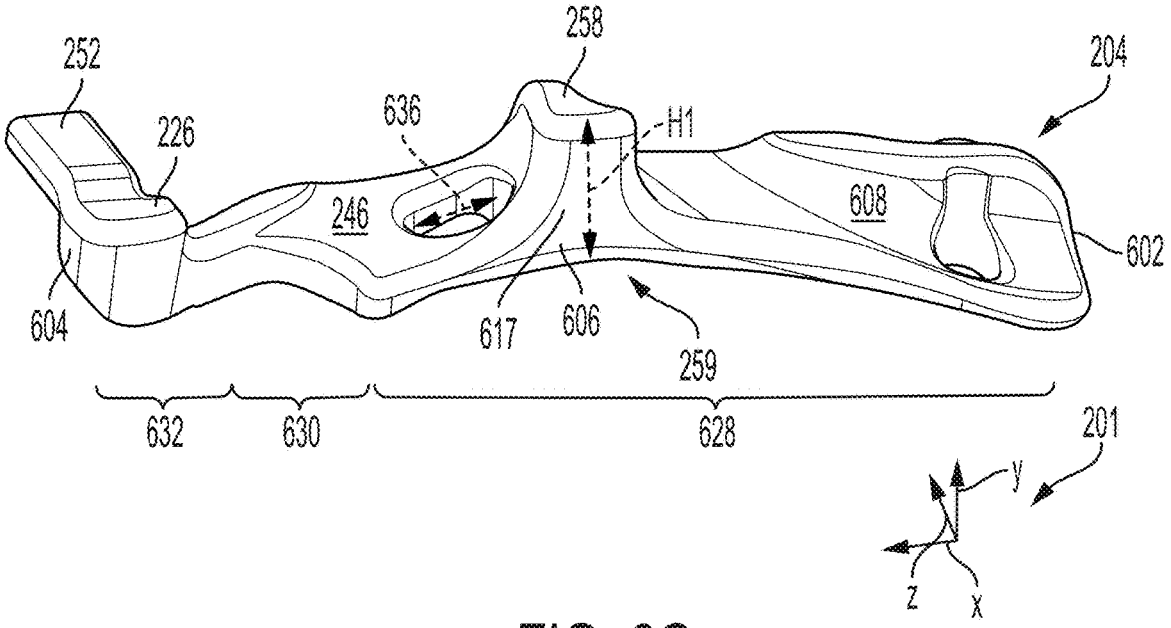
Figure 6D:
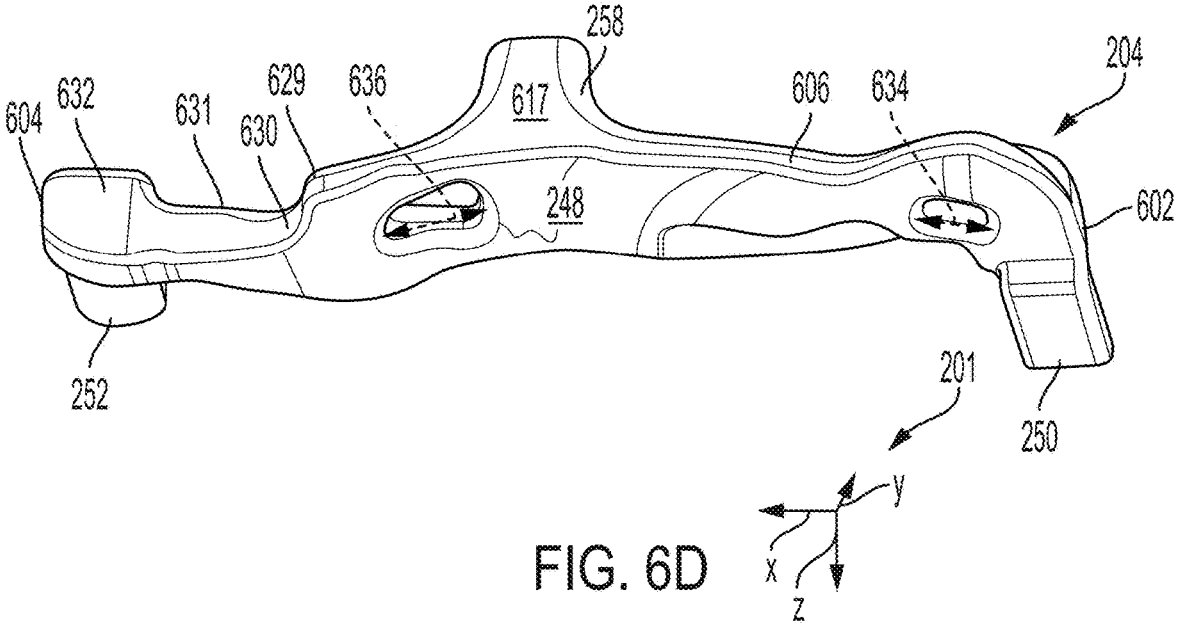

FIGS. 6A-6D show perspective views of the central cooling jacket core 204. FIG. 6A shows a top perspective view, from the left side, of the front of the central cooling jacket core 204. FIG. 6B shows a bottom perspective view of the front of the central cooling jacket core 204. FIG. 6C shows a top perspective view, from the left side, of the back of the central cooling jacket core 204. FIG. 6D shows a bottom perspective view of the back of the central cooling jacket core 204. FIG. 6A through FIG. 6D are described together.

At the first side 240, the central cooling jacket core 204 may include a first longitudinally-extending edge 602 (also referred to as a first side edge 602) and, at the second side 242, a second longitudinally-extending edge 604 (also referred to as a second side edge 604). The central cooling jacket core 204 may also include the front face 244 extending from the first side edge 602 to the second side edge 604 and a rear face 606, opposite the front face 244, extending from the first side edge 602 to the second side edge 604. The first extension 250 and the second extension 252 may extend outward from the front face 244 along the z axis.

The central cooling jacket core 204 has a length L1 extending from the first side edge 602 to the second side edge 604 and a depth D1 extending from the front face 244 to the rear face 606. The depth D1 may be the largest depth of the central cooling jacket core 204, and other regions of the central cooling jacket core 204 may have shallower depths. The central cooling jacket core 204 has varying heights, such as height H1 (shown in FIG. 6C), extending from the bottom side 248 to the top side 246. The illustrated height H1 may be the tallest height of the central cooling jacket core 204.

Along the top side 246 of the central cooling jacket core 204 is the central ridge 258, a first surface 608, and a second surface 610. The central ridge 258 of the central cooling jacket core 204 may be situated at a point (e.g. the midpoint) between the first side edge 602 and the second side edge 604. The first surface 608 may extend from the first side edge 602 to the central ridge 258. The first surface 608 may comprise a first convex portion 612 and a first concave portion 614. The first concave portion 614 may extend from the central ridge 258 to the first convex portion 612 of the first surface 608. The first surface 608, at the first concave portion 614, may be generally curved along the rear face 606 for the extent shown by the bracket in FIG. 6A, while the first surface 608, at the first concave portion 614 along the front face 244, may curve in the concave manner from the central ridge 258 to a point 619 along the front face 244. The length of the concave curved portion of the first surface 608 along the front face 244 may be sized to match a width of an exhaust passage core used to cast the first exhaust passage, as shown in FIG. 7 and explained in more detail below.

A first projection 616 may extend from the first side edge 602 to a point (e.g., the point 619 shown in FIG. 6A) on the first concave portion 614. The first projection 616 may include an upward-bending (e.g., concave) region due to the first surface 608 and the front face 244 each curving upward, that forms a ledge/overhang structure. For example, referring specifically to FIG. 6B, the bottom side 248 includes an overhang surface 603 that forms a bottom of the first projection 616, while the bottom side 248 to the rear of the first projection 616 includes a curved surface 605, with each of the overhang surface 603 and the curved surface 605 extending substantially in an a z-x plane. A vertical surface 607 couples the curved surface 605 to the overhang surface 603, and the vertical surface 607 extends in the x-y plane. The first projection 616 may be provided to more efficiently and evenly cool the IEM. Further, referring back to FIG. 5, the first projection 616 may overhang a second upward projection 278 of the lower cooling jacket core 206.

The central ridge 258 may comprise a front surface 615 (which may be a part of the front face 244), a rear surface 617 (which may be a part of the rear face 606), and a third surface 618, positioned at the vertical top portion of the central ridge 258. The third surface 618 may be approximately flat along the x axis but may be angled upward along the z axis. The third surface 618 may extend from the front surface 615 to the rear surface 617. At the intersection with the front surface 615, the third surface 618 may have a length (e.g., parallel to the x axis) that is smaller than a length of the third surface 618 at the intersection with the rear surface 617, such that the third surface 618 has a triangular shape. The front surface 615 may be triangular shaped, and the rear surface 617 may include a frusto-triangular shape. In this way, the central ridge 258 may increase in length from the front surface 615 to the rear surface 617 and may increase in height from the front surface 615 to the rear surface 617.

The second surface 610 may extend from the central ridge 258 to the second side edge 604. The second surface 610 may comprise a second convex surface 620 and a second concave surface 622. The second convex surface 620 may extend laterally from the second side edge 604 to the second concave surface 622. The second concave surface 622 may extend laterally towards the central ridge 258.

The bottom side 248 may comprise a third concave surface 623 (labeled in FIG. 6B), a fourth concave surface 624, and a third convex surface 626. The third concave surface 623 may extend from the first side edge 602 to the fourth concave surface 624. The third convex surface 626 may extend from the fourth concave surface 624 to the second side edge 604.

The rear face 606 may include a first curved surface 628, a second curved surface 630, and a flat surface 632. The first curved surface 628 may be a concave-shaped surface that curves inward (e.g., toward the front face 244) and then back outward, from approximately the first side edge 602 to a first point 629 on the distal side of the central ridge 258. The second curved surface 630 may extend from the first point 629 to a second point 631, with a radius of curvature that is smaller than the radius of curvature of the first curved surface 628. Additionally, the second curved surface 630 may not curve back outward as much as it curves inward, thus generating an s-shaped curve. The flat surface 632 may extend from the second point 631 to the second side edge 604.

The central cooling jacket core 204 includes a first bore 634 and a second bore 636, which may create flow passages of the central cooling jacket to target coolant flow to certain regions and at desired rates, to cool the exhaust passages, as will be described in more detail below.

FIGS. 7-8 show the front and rear perspectives of the central cooling jacket core 204 positioned between a plurality of exhaust passages cores. In the present example, three exhaust passage cores are shown. FIG. 7 shows a front view 700 of the exhaust passage cores and the central cooling jacket core 204, and FIG. 8 shows a rear view 800 of the exhaust passage cores and the central cooling jacket core 204. The plurality of exhaust passage cores includes a first exhaust passage core 702, a second exhaust passage core 704, and a third exhaust passage core 706. Each exhaust passage core is formed from at least two exhaust runner cores, which merge to form the respective exhaust passage core. For example, a first exhaust runner core 708 and a second exhaust runner core 710 merge to form the second exhaust passage core 704. When the cylinder head is cast, each exhaust runner core may form an exhaust runner coupled to a cylinder and including an exhaust port to accommodate an exhaust valve. In the example shown, the first exhaust runner core 708 and the second exhaust runner core 710 may form a first exhaust runner and a second exhaust runner, respectively, in the cast cylinder head, with the first exhaust runner and the second exhaust runner coupled to the same (e.g., a first) cylinder. The first exhaust passage core 702 may likewise be formed from two exhaust runner cores that merge to form the first exhaust passage core 702, with the two resulting exhaust runners coupled to the same (e.g., a second) cylinder. The third exhaust passage core 706 may be formed from four exhaust runner cores that merge to form the third exhaust passage core 706, with two resulting exhaust runners coupled to the same (e.g., a third) cylinder and two other resultant exhaust runners coupled to a different (e.g., a fourth) cylinder.

The first exhaust passage core 702 and the second exhaust passage core 704 may be horizontally aligned (e.g., aligned along a common axis that is parallel to the x axis of the coordinate system 201). The first exhaust passage core 702 and the second exhaust passage core 704 are positioned vertically above the third exhaust passage core 706. Each of the first exhaust passage core 702, the second exhaust passage core 704, and third exhaust passage core 706 may terminate at a common plane, and the terminating edges of the first exhaust passage core 702, the second exhaust passage core 704, and third exhaust passage core 706 at the common plane may form the exit port of the cylinder head when the cylinder head is cast.

The central cooling jacket 204 is positioned intermediate the third exhaust passage core 706 and the first and second exhaust passage cores 702 and 704. Thus, the first exhaust passage core 702 and the second exhaust passage core 704 are positioned vertically above the central cooling jacket core 204, and the third exhaust passage core 706 is positioned vertically below the central cooling jacket core 204.

The shape (e.g. curvature, angle, thickness) of the central cooling jacket core 204 may be adapted to accommodate the shape of the first, second, and third exhaust passages/cores 702, 704, and 706 and to eliminate "hot spots" between the exhaust passages. For example, the central cooling jacket core 204 comprises the first concave portion 254 which surrounds the lower portion of the first exhaust passage core 702. A space may be left between the first exhaust passage core 702 and the first concave portion 254 of the central cooling jacket core, which may fill with material during casting to create a first wall between the first exhaust passage and the central cooling jacket passage.

The second concave portion 256 of the central cooling jacket core 204 may at least partially surround the lower portion of the second exhaust passage core 704. When used during the casting of the IEM, the central cooling jacket core 204 and the second exhaust passage core 704 may provide a space between which material may flow during casting of the IEM. The space shown between the second exhaust passage core 704 and the central cooling jacket core 204 may form a wall between the second exhaust passage and the central cooling jacket passage. The proximity of the central cooling jacket to the second exhaust passage may facilitate the cooling of the IEM.

In this example, the space between the first exhaust passage core 702 and the second exhaust passage core 704 may be partly filled by the central cooling jacket core 204, and in particular the central ridge 258. The first exhaust passage core 702 and the second exhaust passage core 704 begin curve from the respective exhaust runner cores toward each other, such that each exhaust passage core has a parallel exhaust gas flow axis at the exit port. As a result, the central ridge 258 has the triangular shape described above, e.g., a greater length at the rear than the length at the front, to better fill the space between the first and second exhaust passage cores.

The positioning of the central ridge between the first and second exhaust passages allows coolant to flow between each of the exhaust passages, cooling them more uniformly by circulating coolant between the upper cooling jacket, the central cooling jacket, and the lower cooling jacket. The central cooling jacket core 204 may extend past the laterally-extending width of the exhaust outlets. The width of the central cooling jacket core may allow greater proximity to the exhaust outlets and prevent the formation of "hot spots", while fitting into the packaging requirements imposed by the positioning of the exhaust outlets.

As further appreciated by FIG. 7, the first extension 250 may be positioned vertically lower than the second extension 252. For example, FIG. 7 includes a longitudinal axis 712 that is aligned with a bottom of the second extension 252 and extends generally across a central area of the central cooling jacket 204. The longitudinal axis 712 may be parallel to the x axis. The first extension 250 is positioned below the longitudinal axis 712, with a top of the first extension 250 below the axis 712. As described previously, the second extension 252 may form a first fluidic coupling and the first extension 250 may form a second fluidic coupling. In some examples, coolant may enter the resulting cooling jacket via the second fluidic coupling and traverse the central cooling jacket to exit at the first fluidic coupling.

Further, the central cooling jacket core 204 may extend substantially horizontally (e.g., along the x axis) from the first end of the core to the second end of the core. The central cooling jacket core extend substantially upward along the vertical axis (the y axis) from the first extension 250 to a first point 714, as the top side 246 curves to form the first projection 616. From the first point 714 to a second point 716, the central cooling jacket core 204 may extend relatively horizontally, without any major curves or bends (although the top and rear faces may curve to form the concave portions and the central ridge described herein, the central cooling jacket 204 is substantially centered along the axis 712 from the first point 714 to the second point 716). At the second point 716, the top face and rear face curve upward to the second extension 252. In doing so, coolant may flow through the central cooling jacket along an entire extent (in the horizontal direction) of the exhaust passages, which may be enhance cooling of the exhaust passages and the cylinder head at the turbocharger mounting surface/exit port, relative to cylinder heads without a central cooling jacket, even if drilled passages are present between the upper and lower cooling jackets. Due to constraints on the size and position of the drilled passages, the drilled passages may not target cooling to the areas where cooling is demanded, such as along the lower portions of the upper exhaust passages and upper portion of the lower exhaust passage.

While FIGS. 7 and 8 show three exhaust passage cores, it is to be understood that more or fewer exhaust passage cores could be included without departing from the scope of this disclosure. For example, rather than include three exhaust passage cores, only two exhaust passage cores may be included, arranged in a stacked vertical alignment with the central cooling jacket core 204 positioned vertically intermediate the two exhaust passage cores.

FIGS. 9-10 show front perspective views of the upper cooling jacket core 202, the central cooling jacket core 204, the lower cooling jacket core 206, and a schematic depiction of a degas port 902. FIG. 9 shows a first front perspective view 900 from the right and FIG. 10 shows a second front perspective view 1000 from the left. The degas port 902 may comprise a drilled passage having a first portion 904 and a second portion 906. The degas port 902 may be drilled in the cylinder head after casting, although other mechanisms of forming the degas port are possible, such as using a lost core. Similar to the cooling jacket cores, the degas port 902 represents a negative view of the degas port within the cylinder head, and may represent the shape of the passage that is drilled after the cylinder head is cast.

The first portion 904 of the degas port 902 may extend from the topmost surface of the cylinder head (e.g., the deck face, such as deck face 154 of FIG. 13) vertically downwards and longitudinally towards the rear of the upper cooling jacket (e.g., the first portion 904 is angled along the y axis). The first portion 904 may couple to the ridge of the upper cooling jacket. For example, as shown, the first portion 904 may couple to the ridge 228 of the upper cooling jacket core 202. Thus, a fluidic coupling is established between the degas port 902 and the upper cooling jacket at the ridge, which may be the vertically-highest point of the upper cooling jacket.

The second portion 906 of the degas port 902 extends from the bottom side of the upper cooling jacket and is coupled to the central cooling jacket. For example, as shown, the second portion 906 may couple to the bottom side xx of the upper cooling jacket core 202 and may couple to the top surface of the central ridge 258 of the central cooling jacket core 204, which may be the vertically-highest (or nearly the vertically-highest, such as within 1-2 cm of the vertically-highest portion) point of the central cooling jacket core 204. Thus, a fluidic coupling is established between the upper cooling jacket core and the central cooling jacket core via the second portion of the degas port. The second portion 906 may be angled at the same angle as the first portion 904.

The degas port 902 may fluidly connect the upper cooling jacket and the central cooling jacket and provide a path for evaporated coolant gasses to flow out of the cooling jackets and to other components of the coolant system. For example, the degas port 902 may be coupled to a degas bottle of the vehicle cooling system.

FIG. 11 shows a cross section view 1100 of a cylinder head 1101, such as cylinder head 150, taken across a line parallel to the z axis at a center of the cylinder head, such as line 192 shown in FIG. 13. The cylinder head 1101 includes an upper cooling jacket 1102, a central cooling jacket 1104, and a lower cooling jacket 1106. The cylinder head 1101 further includes a second exhaust passage 1108, a third exhaust passage 1110, and a degas port 1112. The second exhaust passage 1108 and the third exhaust passage 1110 may terminate at an exit port 1111 of the cylinder head 1101.

The cylinder head 1101 may be formed by casting using a plurality of cooling jacket cores, a plurality of exhaust passage cores, etc., in order to form the cooling jackets and exhaust passages described herein. For example, the upper cooling jacket 1102 may be formed by the upper cooling jacket core 202, the central cooling jacket 1104 may be formed by the central cooling jacket core 204, the lower cooling jacket 1106 may be formed by the lower cooling jacket core 206, the second exhaust passage 1108 may be formed by the second exhaust passage core 704, the third exhaust passage 1110 may be formed by the third exhaust passage core 706, and the degas port 1112 may be formed via drilling after the cylinder head has been cast. FIG. 11 does not include the first exhaust passage, but it is to be appreciated that the first exhaust passage may be formed by the first exhaust passage core 702.

The path of the degas port 1112 is shown to extend from the deck face of the cylinder head 1101 through an upper ridge 1114 of the upper cooling jacket 1102, through a wall 1116 between the central cooling jacket 1104 and the upper cooling jacket 1102, and into the central cooling jacket 1104 at a central ridge 1118 of the central cooling jacket 1104.

The degas port 1112 is described with respect to FIG. 11 as including the drilled passage (including both the first portion between the deck face and the upper cooling jacket and the second portion between the upper cooling jacket and the central cooling jacket) and the opening formed by the drilled passage at the deck face of the cylinder head (to which a fluidic coupling is provided to a degas bottle, for example). However, it is to be appreciated that in some examples, the degas port may only refer to the opening in the cylinder deck face, and that the degas port may be formed by and fluidly coupled to the drilled passage.

Thus, as shown and described herein, an exhaust manifold for an engine may include a plurality of exhaust runners coupling a plurality of cylinder exhaust gas outlet ports to an exhaust exit port. The plurality of exhaust runners may form at least an upper, first exhaust passage and a lower, second exhaust passage at the exhaust exit port. For example, as shown in FIGS. 7 and 8, the exhaust runner cores may merge to form the first exhaust passage core, the a second exhaust passage core, and the third exhaust passage core. The cores shown and described with respect to FIGS. 7 and 8 may be used to cast a cylinder head resulting in at least the first exhaust passage and the second exhaust passage at the exhaust exit port, as shown by the second exhaust passage 1108 and the third exhaust passage 1110 at the exit port 1111 of FIG. 11 (where the second exhaust passage 1108 is the upper exhaust passage and the third exhaust passage 1110 is the lower exhaust passage). The exhaust manifold is integrated within a cylinder head, as shown in FIGS. 11 and 13.

The exhaust manifold may further include an upper cooling jacket positioned vertically above the first/upper exhaust passage, a lower cooling jacket positioned vertically below the second/lower exhaust passage, and a central cooling jacket positioned vertically below the first/upper exhaust passage and vertically above the second/lower exhaust passage. For example, the set of cooling jacket cores shown in FIGS. 2-5 may be used to cast the upper cooling jacket 1102, the central cooling jacket 1104, and the lower cooling jacket 1106, and as shown in FIG. 11, the upper cooling jacket 1102 is positioned vertically above the upper, second exhaust passage 1108, the lower cooling jacket 1106 is positioned vertically below the lower, third exhaust passage 1110, and the central cooling jacket 1104 is positioned vertically below the upper/second exhaust passage 1108 and vertically above the lower/third exhaust passage 1110.

Further, the upper cooling jacket and the central cooling jacket collectively form a first channel at least partially surrounding the upper/first exhaust passage, and the central cooling jacket and the lower cooling jacket collectively form a second channel at least partially surrounding the lower/second exhaust passage. For example, as shown in FIGS. 2-5, the second concave portion 226 and the second concave portion 256 form a channel at least partially surrounding the second exhaust passage and the third concave portion 259 and the first concave portion 272 form a channel at least partially surrounding the third exhaust passage. As used herein, at least partially surrounding an exhaust passage may include at least partially surrounding an outer circumference of the exhaust passage at one or more points along an extent of the exhaust passage. For example, the second concave portion 226 and the second concave portion 256 form a channel that surrounds at least 50% of the circumference of the second exhaust passage at least at one point along the extent of the second exhaust passage (e.g., along the z axis of the coordinate system shown herein).

Additionally, the exhaust manifold includes another upper exhaust passage that is horizontally aligned with the upper/first exhaust passage, and the central cooling jacket includes a ridge (e.g., the central ridge 258) that extends upward from a top portion of the central cooling jacket, and the ridge is positioned intermediate the two upper exhaust passages (the first exhaust passage and the second exhaust passage as shown in FIGS. 7-8). The ridge forms part of the first channel described above. Further, the upper cooling jacket and the central cooling jacket collectively form an additional channel that at least partially surrounds the additional upper exhaust passage, and the ridge forms part of the additional channel.

The central cooling jacket may be fluidly coupled to the lower cooling jacket at a first end of the central cooling jacket and may be fluidly coupled to the upper cooling jacket at a second end of the central cooling jacket. For example, at the first side 240 of the central cooling jacket core 204, the central cooling jacket core forms a connection with the lower cooling jacket core 206 that, after casting, results in a fluidic coupling between the central and lower cooling jackets. At the second side 242 of the central cooling jacket core 204, the central cooling jacket core forms a connection with the upper cooling jacket core 202 that, after casting, results in a fluidic coupling between the central and upper cooling jackets.

Further, the upper cooling jacket extends a first distance along one of the upper exhaust passages (e.g., the first exhaust passage core 702), parallel to a transverse axis (e.g., the z axis), and the central cooling jacket extends a second distance along the that exhaust passage, parallel to the transverse axis, and the second distance is shorter than the first distance. For example, referring to FIG. 6A, the central cooling jacket may have a depth D1 along the surface 608 at the first concave portion 254, from the front face 244 to the rear face 606 parallel to the z axis. Referring to FIG. 3, the upper cooling jacket core have a larger depth D2 from the front face 212 to the rear face, e.g., a depth D2 that is two or three times the depth D1. The central cooling jacket is positioned vertically below the upper exhaust passage and vertically above the lower exhaust passage with respect to a vertical axis that is parallel to a direction of gravity when a vehicle including the exhaust manifold is on a driving surface, and the transverse axis is perpendicular to the vertical axis. Further, as shown in FIG. 11, a drilled passage fluidly couples the central cooling jacket to a degas port at a deck face of the cylinder head, the degas port configured to fluidly couple to a degas bottle.

FIGS. 12A-12C show a set of coolant flow rate maps of the cooling jackets described herein. FIG. 12A shows a first map 1200, FIG. 12B shows a second map 1202, and FIG. 12C shows a third map 1204, each of differing magnifications and/or perspectives and including color gradients imposed over the negative space depictions of an upper cooling jacket 1206, a central cooling jacket 1208, and a lower cooling jacket 1210 resulting from casting of the upper cooling jacket core 202, the central cooling jacket core 204, and the lower cooling jacket core 206. The color gradients are indicative of the relative velocity of coolant flowing through cooling jackets during operation of the cooling system (e.g., when a cooling pump is activated to flow coolant through the cooling jackets). Map 1200 depicts a zoomed out view of the cooling jackets, while maps 1202 and 1204 each depicted magnified views focused on the central ridge of the central cooling jacket 1208.

As shown by the legend 1201 in each map, the colors correspond to the relative velocity magnitude of the coolant flow in meters per second (m/s). Red corresponds to a coolant velocity of approximately 3.00 m/s or greater. Dark blue corresponds to a coolant velocity of 0.00 m/s. The gradient colors between these correspond to values between 0.00 and 2.50 m/s. Blue corresponds to a velocity of 0.50 m/s, cyan corresponds to a velocity of 1.00 m/s, green corresponds to a velocity of 1.50 m/s and yellow corresponds to a velocity of 2.00 m/s, and orange corresponds to a velocity of 2.50 m/s.

As appreciated by maps 1200, 1202, and 1204, the cooling jackets include areas where coolant velocity is relatively high, areas where coolant velocity is relatively low, and areas where coolant velocity is intermediate. The cooling jackets may be configured to provide coolant at a desired flow velocity depending on the cooling demands of the cylinder head at that region. For example, areas of high velocity, where coolant velocity may be equal to or higher than 2.5 m/s include regions along the front face of the central cooling jacket 1208, such as first region 1216 and second region 1218. The central ridge 1212 of the central cooling jacket 1208 may have areas of low velocity, except a region 1214 around the degas port, which may exhibit high coolant velocity (e.g., above 2.0 m/s).

The areas of high velocity may be created to allow more efficient cooling of the exhaust passages and spaces therebetween. The inclusion of the central cooling jacket may allow for additional cooling between the stacked exhaust passages. For example, first region 1216 and second region 1218 are areas of high coolant flow velocity in the central cooling jacket that may provide enhanced cooling to all three exhaust passages, as the first region 1216 and the second region 1218 are positioned vertically below the first exhaust passage and second exhaust passage and in fluid contact with the walls forming the lower portion of the first exhaust passage and second exhaust passage. Likewise, the first region 1216 and the second region 1218 are positioned vertically above the third exhaust passage and in fluid contact with the wall(s) forming the upper portion of the third exhaust passage. In some examples, the central cooling jacket includes one or more bifurcated sections and/or one or more curved sections configured to increase a flow velocity of coolant flowing through a front side of the central cooling jacket relative to a flow velocity of coolant flowing through a rear side of the central cooling jacket. For example, the second bore 636 may create a bifurcated passage for coolant to flow, which may result in the higher coolant flow velocity at the second region 1218 relative to the flow velocity at a third region 1220 at the rear side of the central cooling jacket. The passages closest to the turbo mounting flange are configured to have higher velocity of coolant flow, in order to provide enhanced cooling to the turbo mounting flange.

The rear side of the passages, away from the turbo, is of secondary importance, but serves to provide increased flow velocity where the exhaust passages overlap. The cutout in the center of the middle core, the second bore 636 in FIGS. 6C and 6D, directs flow upward and reduces the tendency for flow recirculation, which improves temperature and reduces boiling. The cutout in the center of the middle core, the first bore 634 in FIG. 6D, increases flow velocity locally to provide enhanced cooling to the rear side, where the exhaust runners overlap, and sets the flow in position to cool the center of the turbo flange, downstream.

The disclosure also provides support for an exhaust manifold for an engine, comprising: a plurality of exhaust runners coupling a plurality of cylinder exhaust gas outlet ports to an exhaust exit port, the plurality of exhaust runners forming at least a first exhaust passage and a second exhaust passage at the exhaust exit port, an upper cooling jacket positioned vertically above the first exhaust passage, a lower cooling jacket positioned vertically below the second exhaust passage, and a central cooling jacket positioned vertically below the first exhaust passage and vertically above the second exhaust passage. In a first example, the exhaust manifold is integrated within a cylinder head. In a second example, optionally including the first example, the upper cooling jacket and the central cooling jacket collectively form a first channel at least partially surrounding the first exhaust passage. In a third example, optionally including one or both the first and second examples, the central cooling jacket and the lower cooling jacket collectively form a second channel at least partially surrounding the second exhaust passage. In a fourth example, optionally including one or more or each of the first through third examples, the plurality of exhaust runners form the first exhaust passage, the second exhaust passage, and a third exhaust passage at the exhaust exit port, the third exhaust passage horizontally aligned with the first exhaust passage, and wherein the central cooling jacket includes a ridge that extends upward from a top portion of the central cooling jacket, the ridge positioned intermediate the first exhaust passage and the third exhaust passage. In a fifth example, optionally including one or more or each of the first through fourth examples, the upper cooling jacket and the central cooling jacket collectively form a third channel at least partially surrounding the third exhaust passage and wherein the ridge forms part of the first channel and the second channel. In a sixth example, optionally including one or more or each of the first through fifth examples, the central cooling jacket is fluidly coupled to the lower cooling jacket at a first end of the central cooling jacket and is fluidly coupled to the upper cooling jacket at a second end of the central cooling jacket. In a seventh example, optionally including one or more or each of the first through sixth examples, the upper cooling jacket extends a first distance along the first exhaust passage, parallel to a horizontal axis, and the central cooling jacket extends a second distance along the first exhaust passage, parallel to the horizontal axis, and the second distance is shorter than the first distance. In an eighth example, optionally including one or more or each of the first through seventh examples, the central cooling jacket is positioned vertically below the first exhaust passage and vertically above the second exhaust passage with respect to a vertical axis that is parallel to a direction of gravity when a vehicle including the exhaust manifold is on a driving surface, and wherein the horizontal axis is perpendicular to the vertical axis. In a ninth example, optionally including one or more or each of the first through eighth examples, the exhaust manifold further comprises: a drilled passage fluidly coupling the central cooling jacket to a degas port, the degas port configured to fluidly couple to a degas bottle.

The disclosure also provides support for an exhaust manifold integrated in a cylinder head of an engine, comprising: a plurality of exhaust runners coupling a plurality of cylinder exhaust gas outlet ports to an exhaust exit port, the plurality of exhaust runners forming a first exhaust passage, a second exhaust passage, and a third exhaust passage at the exhaust exit port, a passage terminating at a degas port, an upper cooling jacket positioned vertically above the first exhaust passage and the second exhaust passage, a lower cooling jacket positioned vertically below the third exhaust passage, and a central cooling jacket positioned vertically below the first exhaust passage and the second exhaust passage and vertically above the third exhaust passage, the central cooling jacket including a ridge extending upward from a top portion of the central cooling jacket, the ridge positioned intermediate the first exhaust passage and the second exhaust passage and fluidly coupled to the passage. In a first example, the ridge forms a vertically-highest portion of the central cooling jacket. In a second example, optionally including the first example, the central cooling jacket includes one or more bifurcated sections and/or one or more curved sections configured to increase a flow velocity of coolant flowing through a front side of the central cooling jacket relative to a flow velocity of coolant flowing through a rear side of the central cooling jacket. In a third example, optionally including one or both of the first and second examples, the front side of the central cooling jacket is proximate to and faces a turbocharger mounting surface of the exhaust manifold.

The disclosure also provides support for an exhaust manifold for an engine, comprising: a plurality of exhaust runners coupling a plurality of cylinder exhaust gas outlet ports to an exhaust exit port, the plurality of exhaust runners forming a first exhaust passage, a second exhaust passage, and a third exhaust passage at the exhaust exit port, an upper cooling jacket positioned vertically above the first exhaust passage and the second exhaust passage, a lower cooling jacket positioned vertically below the third exhaust passage, and a central cooling jacket positioned vertically below the first exhaust passage and the second exhaust passage and vertically above the third exhaust passage, the central cooling jacket fluidly coupled to the lower cooling jacket at a first fluidic coupling located at a first end of the central cooling jacket and fluidly coupled to the upper cooling jacket at a second fluidic coupling located at a second end of the central cooling jacket, the central cooling jacket maintained fluidly separate from the lower cooling jacket along an entirety of the central cooling jacket other than at the first fluidic coupling. In a first example, the exhaust manifold further comprises: a degas passage terminating at a degas port, the degas passage fluidly coupled to the central cooling jacket at a ridge of the central cooling jacket, the ridge positioned intermediate the first exhaust passage and the second exhaust passage. In a second, optionally including the first example, the central cooling jacket is maintained fluidly separate from the upper cooling jacket along the entirety of the central cooling jacket other than at the second fluidic coupling and a third fluidic coupling provided via the degas passage. In a third example, optionally including one or both the first and second examples, the central cooling jacket is positioned vertically below the first exhaust passage and the second exhaust passage and vertically above the third exhaust passage with respect to a vertical axis that is parallel to a direction of gravity when a vehicle including the exhaust manifold is on a driving surface, and wherein the central cooling jacket has a longitudinal axis perpendicular to the vertical axis, and coolant is configured to flow from the first fluidic coupling to the second fluidic coupling along the longitudinal axis.

FIGS. 1-13 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust manifold for an engine, comprising:

a plurality of exhaust runners coupling a plurality of cylinder exhaust gas outlet ports to an exhaust exit port, the plurality of exhaust runners forming a first exhaust passage, a second exhaust passage, and a third exhaust passage at the exhaust exit port, the third exhaust passage horizontally aligned with the first exhaust passage;

an upper cooling jacket positioned vertically above the first exhaust passage;

a lower cooling jacket positioned vertically below the second exhaust passage; and a central cooling jacket positioned vertically below the first exhaust passage and vertically above the second exhaust passage and including a ridge that extends upward from a top portion of the central cooling jacket, the ridge positioned intermediate the first exhaust passage and the third exhaust passage.

2. The exhaust manifold of claim 1, wherein the exhaust manifold is integrated within a cylinder head.

3. The exhaust manifold of claim 1, wherein the upper cooling jacket and the central cooling jacket collectively form a first channel at least partially surrounding the first exhaust passage.

4. The exhaust manifold of claim 3, wherein the central cooling jacket and the lower cooling jacket collectively form a second channel at least partially surrounding the second exhaust passage.

5. The exhaust manifold of claim 4, wherein the upper cooling jacket and the central cooling jacket collectively form a third channel at least partially surrounding the third exhaust passage and wherein the ridge forms part of the first channel and the second channel.

6. The exhaust manifold of claim 1, wherein the central cooling jacket is fluidly coupled to the lower cooling jacket at a first end of the central cooling jacket and is fluidly coupled to the upper cooling jacket at a second end of the central cooling jacket.

7. The exhaust manifold of claim 1, wherein the upper cooling jacket extends a first distance along the first exhaust passage, parallel to a horizontal axis, and the central cooling jacket extends a second distance along the first exhaust passage, parallel to the horizontal axis, and the second distance is shorter than the first distance.

8. The exhaust manifold of claim 7, wherein the central cooling jacket is positioned vertically below the first exhaust passage and vertically above the second exhaust passage with respect to a vertical axis that is parallel to a direction of gravity when a vehicle including the exhaust manifold is on a driving surface, and wherein the horizontal axis is perpendicular to the vertical axis.

9. The exhaust manifold of claim 1, further comprising a drilled passage fluidly coupling the central cooling jacket to a degas port, the degas port configured to fluidly couple to a degas bottle.

10. An exhaust manifold integrated in a cylinder head of an engine, comprising:

a plurality of exhaust runners coupling a plurality of cylinder exhaust gas outlet ports to an exhaust exit port, the plurality of exhaust runners forming a first exhaust passage, a second exhaust passage, and a third exhaust passage at the exhaust exit port;

a passage terminating at a degas port;

an upper cooling jacket positioned vertically above the first exhaust passage and the second exhaust passage;

a lower cooling jacket positioned vertically below the third exhaust passage; and a central cooling jacket positioned vertically below the first exhaust passage and the second exhaust passage and vertically above the third exhaust passage, the central cooling jacket including a ridge extending upward from a top portion of the central cooling jacket, the ridge positioned intermediate the first exhaust passage and the second exhaust passage and fluidly coupled to the passage.

11. The exhaust manifold of claim 10, wherein the ridge forms a vertically-highest portion of the central cooling jacket.

12. The exhaust manifold of claim 10, wherein the central cooling jacket includes one or more bifurcated sections and/or one or more curved sections configured to increase a flow velocity of coolant flowing through a front side of the central cooling jacket relative to a flow velocity of coolant flowing through a rear side of the central cooling jacket.

13. The exhaust manifold of claim 12, wherein the front side of the central cooling jacket is proximate to and faces a turbocharger mounting surface of the exhaust manifold.

14. An exhaust manifold for an engine, comprising:

a plurality of exhaust runners coupling a plurality of cylinder exhaust gas outlet ports to an exhaust exit port, the plurality of exhaust runners forming a first exhaust passage, a second exhaust passage, and a third exhaust passage at the exhaust exit port;

an upper cooling jacket positioned vertically above the first exhaust passage and the second exhaust passage;

a lower cooling jacket positioned vertically below the third exhaust passage; and a central cooling jacket positioned vertically below the first exhaust passage and the second exhaust passage and vertically above the third exhaust passage, the central cooling jacket fluidly coupled to the lower cooling jacket at a first fluidic coupling located at a first end of the central cooling jacket and fluidly coupled to the upper cooling jacket at a second fluidic coupling located at a second end of the central cooling jacket, the central cooling jacket maintained fluidly separate from the lower cooling jacket along an entirety of the central cooling jacket other than at the first fluidic coupling.

15. The exhaust manifold of claim 14, further comprising a degas passage terminating at a degas port, the degas passage fluidly coupled to the central cooling jacket at a ridge of the central cooling jacket, the ridge positioned intermediate the first exhaust passage and the second exhaust passage.

16. The exhaust manifold of claim 15, wherein the central cooling jacket is maintained fluidly separate from the upper cooling jacket along the entirety of the central cooling jacket other than at the second fluidic coupling and a third fluidic coupling provided via the degas passage.

17. The exhaust manifold of claim 15, wherein the central cooling jacket is positioned vertically below the first exhaust passage and the second exhaust passage and vertically above the third exhaust passage with respect to a vertical axis that is parallel to a direction of gravity when a vehicle including the exhaust manifold is on a driving surface, and wherein the central cooling jacket has a longitudinal axis perpendicular to the vertical axis, and coolant is configured to flow from the first fluidic coupling to the second fluidic coupling along the longitudinal axis.

* * * * *